US006582892B2

(12) United States Patent
Kong et al.

(10) Patent No.: US 6,582,892 B2
(45) Date of Patent: Jun. 24, 2003

(54) HEAT-STABILIZED IR-SENSITIVE THERMALLY DEVELOPABLE IMAGING MATERIALS

(75) Inventors: Steven H. Kong, Woodbury, MN (US); Bryan V. Hunt, Fridley, MN (US); William D. Ramsden, Afton, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/897,297

(22) Filed: Jun. 29, 2001

(65) Prior Publication Data

US 2003/0091943 A1 May 15, 2003

(51) Int. Cl.[7] ..... G03C 1/498; G03C 1/815; G03C 1/20

(52) U.S. Cl. ..... 430/350; 430/264; 430/510; 430/517; 430/523; 430/577; 430/584; 430/607; 430/619; 430/620; 430/944; 430/945; 430/965

(58) Field of Search ..... 430/619, 350, 430/264, 510, 523, 517, 577, 584, 607, 620, 944, 945, 965

(56) References Cited

U.S. PATENT DOCUMENTS

| | | | | | |
|---|---|---|---|---|---|
| 5,258,282 | A | * | 11/1993 | Kagami et al. | 430/619 |
| 5,380,635 | A | | 1/1995 | Gomez et al. | |
| 5,441,866 | A | | 8/1995 | Miller et al. | |
| 5,541,054 | A | | 7/1996 | Miller et al. | |
| 5,637,449 | A | * | 6/1997 | Harring et al. | 430/619 |
| 5,686,228 | A | * | 11/1997 | Murray et al. | 430/350 |
| 5,705,324 | A | * | 1/1998 | Murray | 430/619 |
| 5,763,153 | A | * | 6/1998 | Tsuzuki et al. | 430/584 |
| 5,922,529 | A | * | 7/1999 | Tsuzuki et al. | 430/619 |
| 5,985,537 | A | | 11/1999 | Philip, Jr. et al. | |
| 5,998,126 | A | | 12/1999 | Toya et al. | |
| 6,068,968 | A | | 5/2000 | Tsuzuki et al. | |
| 6,117,624 | A | | 9/2000 | Shor et al. | |
| 6,153,372 | A | * | 11/2000 | Arai et al. | 430/619 |
| 6,165,706 | A | | 12/2000 | Fujiwara et al. | |
| 6,329,135 | B1 | * | 12/2001 | Kashiwagi | 430/619 |

FOREIGN PATENT DOCUMENTS

| | | |
|---|---|---|
| EP | 0 342 810 | 11/1989 |
| EP | 0 805 376 A2 | 11/1997 |
| JP | 8-275364 | 9/1996 |
| JP | 10-104780 | 4/1998 |

* cited by examiner

*Primary Examiner*—Thorl Chea
(74) *Attorney, Agent, or Firm*—J. Lanny Tucker; Louis M. Leichter

(57) ABSTRACT

A black-and-white photothermographic material that is sensitive at a wavelength greater than 700 nm, and comprises a support having thereon one or more thermally-developable imaging layers comprising a binder and in reactive association, a photosensitive silver halide, a non-photosensitive source of reducible silver ions, and a reducing composition for the non-photosensitive source reducible silver ions. The thermally-developable layers further comprises one or more indolenine dyes as post-processing stabilizing compounds and one or more merocyanine dyes or cyanine spectral sensitizing dyes that comprise one or more thioalkyl, thioaryl, or thioether groups.

32 Claims, 3 Drawing Sheets

HEAT-STABILIZED IR-SENSITIVE THERMALLY DEVELOPABLE IMAGING MATERIALS

FIELD OF THE INVENTION

This invention relates to thermally developable imaging materials such as photothermographic materials. More particularly, it relates to photothermographic imaging materials that are sensitive to infrared imaging radiation and exhibit improved stability to heat over time. The invention also relates to methods of imaging using these materials. This invention is directed to the photothermographic imaging industry.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet or infrared radiation) and developed by the use of thermal energy. These materials, also known as "dry silver" materials, generally comprise a support having coated thereon: (a) photosensitive catalyst (such as silver halide) that upon such exposure provides a latent image in exposed grains that is capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [Klosterboer, *Imaging Processes and Materials* (*Neblette's Eighth Edition*), Sturge, Walworth & Shepp (Eds.), Van Nostrand-Reinhold, New York, Chapter 9, pp. 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide, have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in situ", for example, by mixing an organic or inorganic halide-containing source with a source of reducible silver ions to achieve partial metathesis and thus causing the in situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Usanov et al., *J. Imag. Sci. Tech.* 40, 104 (1996)]. Alternatively, a portion of the reducible silver ions can be completely converted to silver halide, and that portion can be added back to the source of reducible silver ions (see Usanov et al., International Conference on Imaging Science, Sep. 7–11, 1998)

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent for silver ion. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography", the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.*, 1998, 42, 23.

Problem to be Solved

Thermally developable materials have gained widespread use in several industries, particularly in radiography.

A common problem that may exist with some photothermographic imaging materials is "post-processing" instability of the image (that is, image instability during "dark" storage). Photosensitive silver halide remaining in the materials after imaging and development may continue to cause image formation. Such materials are exposed to a wide range of storage or transport temperatures after imaging. Under higher storage temperatures, post-processing instability and the resulting density changes may be even more pronounced over time, resulting in increases in $D_{min}$ (that is, fogging), or changes in density of the image.

Various compounds have been added to photothermographic materials as "post-processing stabilizers". Most often these are sulfur-containing compounds such as mercaptans, thiones, and thioethers. Specific classes of compounds that serve this purpose include the mercapto-substituted triazoles described in U.S. Pat. No. 5,149,620 (Simpson et al.), amido compounds described in U.S. Pat. No. 5,158,866 (Simpson et al.), azlactones described in U.S. Pat. No. 5,175,081 (Krepski et al.), alkyltriazoles described in U.S. Pat. No. 5,196,301 (Simpson et al.), compounds with nitrile blocking groups described in U.S. Pat. No. 5,300,420 (Kenney et al.), silyl-blocked compounds as described in U.S. Pat. No. 5,358,843 (Sakizadeh et al.), tribromosulfonyl compounds as described in U.S. Pat. No. 5,369,000 (Sakizadeh et al.) and U.S. Pat. No. 5,464,737 (Sakizadeh et al.), phthalimide-blocked compounds as described in U.S. Pat. No. 5,439,790 (Muthyala et al.), and mercapto-substituted tetrazoles as described in U.S. Pat. No. 5,681,693 (Bertoldi et al.).

While the noted compounds have provided a solution to the problem of post-processing instability, merely putting such compounds into photothermographic materials may not always provide optimum effectiveness. For example, some of the post-processing stabilizers have blocking groups that must be released during heat development to provide the desired effects. In some instances, there is inadequate release of the stabilizing moiety within the desired heat development time. Other known post-processing stabilizing compounds may contribute to fogging or cause a loss in photographic sensitivity, maximum density ($D_{max}$), or contrast at the concentrations needed for post-processing stabilization.

Thus, there is a need in the industry to improve the post-processing stability of photothermographic materials under various storage conditions without any accompanying increase in fogging or unacceptable loss in photospeed and other sensitometric properties.

SUMMARY OF THE INVENTION

This invention provides a black-and-white photothermographic material that is sensitive at a wavelength greater than 700 nm, and comprises a support having thereon one or more thermally-developable imaging layers comprising a binder and in reactive association, a photosensitive silver halide, a non-photosensitive source of reducible silver ions, a reducing composition for the non-photosensitive source reducible silver ions, and a spectral sensitizing dye for the photosensitive silver halide that is a merocyanine dye or a cyanine dye that comprises one or more thioalkyl, thioaryl, or thioether groups, wherein the one or more thermally-developable layers further comprises one or more indolenine dyes as post-processing stabilizing compounds.

Further, a method of this invention for forming a visible image comprises:

A) imagewise exposing the black and white photothermographic material described above to electromagnetic radiation at a wavelength greater than 700 nm to form a latent image, and B) simultaneously or sequentially, heating the exposed photothermographic material to develop the latent image into a visible image.

In some embodiments of the imaging method of this invention, the photothermographic material has a transparent support and the imaging method further includes:

C) positioning the exposed and heat-developed photothermographic material between a source of imaging radiation and an imageable material that is sensitive to the imaging radiation, and D) thereafter exposing the imageable material to the imaging radiation through the visible image in the exposed and heat-developed photothermographic material to provide an image in the imageable material.

The photothermographic materials of this invention exhibit improved post-processing stability after imaging. Thus, they are less likely to exhibit an increase in $D_{min}$ or change in density in the mid-tone regions when exposed to various temperatures during transport or storage of the imaged materials. The resulting images thus have improved aging characteristics. The photothermographic materials of this invention are also more useful in high temperature climates.

These advantages have been achieved by incorporating certain indolenine dyes into the thermally developable imaging layers on the frontside of the photothermographic materials as post-processing stabilizing compounds. The details of these dyes are provided below.

DETAILED DESCRIPTION OF THE INVENTION

Figure 1:
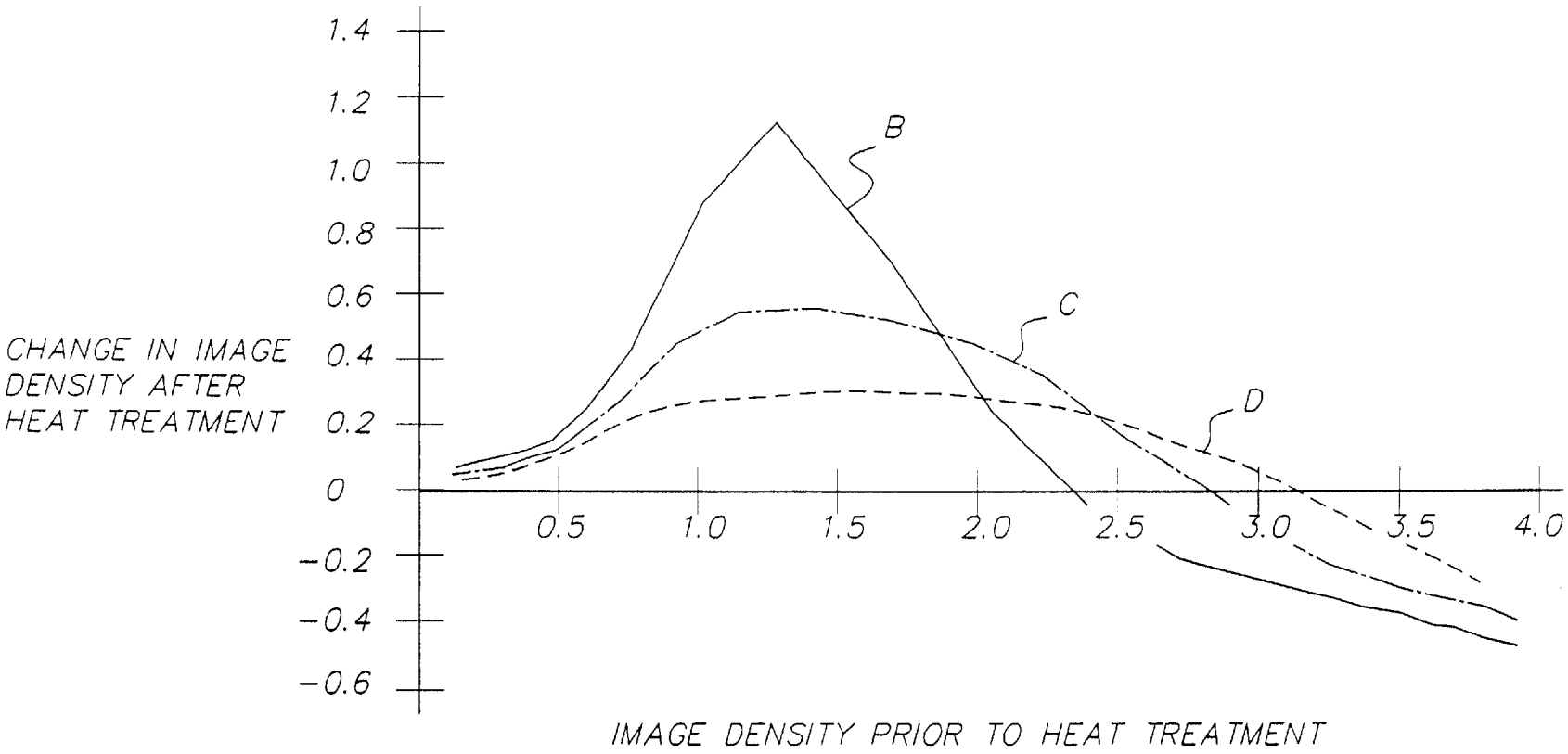
FIG. 1 is a graphical representation of the change (Δ) in image density after heat treatment vs. the initial image density after illumination with fluorescent light but before heat treatment, as described in Example 2 below.

The photothermographic materials of this invention can be used, for example, in conventional black-and-white photothermography, in electronically generated black-and-white hardcopy recording. They can be used in microfilm applications, in radiographic imaging (for example, digital medical imaging), and industrial radiography. Furthermore, the absorbance of these photothermographic materials between 350 and 450 nm is desirably low (less than 0.5), to permit their use in the graphic arts area (for example, imagesetting and photo-typesetting), in the manufacture of printing plates, in contact printing, in duplicating ("duping"), and in proofing. The photothermographic materials of this invention are particularly useful for medical radiography to provide black-and-white images.

The photothermographic materials of this invention are sensitive to radiation at a wavelength of at least 700 nm, and preferably at a wavelength of from about 750 to about 1400 nm.

In the photothermographic materials of this invention, the components needed for imaging can be in one or more layers. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity (or reactive association) and preferably in the same emulsion layer.

Various layers are usually disposed on the "backside" (non-emulsion side) of the materials, including antihalation layer(s), protective layers, antistatic layers, conducting layers, and transport enabling layers.

Various layers are also usually disposed on the "frontside" or emulsion side of the support, including protective topcoat layers, primer layers, interlayers, opacifying layers, antistatic layers, antihalation layers, acutance layers, auxiliary layers, and others readily apparent to one skilled in the art.

The process for the formation of a visible image (usually a black-and-white image) comprises first exposing to electromagnetic radiation and thereafter heating the inventive photothermographic material. Thus, the imaging process generally comprises:

A) imagewise exposing the photothermographic material of this invention to electromagnetic radiation to which the photocatalyst (for example, a photosensitive silver halide) of the material is sensitive, to generate a latent image, and B) simultaneously or sequentially, heating the exposed material to develop the latent image into a visible image.

This visible image can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the exposed and heat-developed photothermographic material of this invention using steps C) and D) noted above.

When the photothermographic materials of this invention are heat-developed, as described below, in a substantially water-free condition after, or simultaneously with, image-wise exposure, a silver image (preferably a black-and-white silver image) is obtained. The photothermographic material may be exposed in step A using infrared radiation using an infrared laser, an infrared laser diode, a light-emitting screen, CRT tube, a light-emitting diode, or other infrared radiation source readily apparent to one skilled in the art.

Definitions

As used herein:

In the descriptions of the photothermographic materials of the present invention, "a" or "an" component refers to "at least one" of that component. For example, the indolenine post-processing stabilizing compounds and merocyanine and cyanine spectral sensitizing dyes described herein can be used individually or in mixtures.

Heating in a substantially water-free condition as used herein, means heating at a temperature of from about 50° to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer", "imaging layer", or "photothermographic emulsion layer", means a layer of a photothermographic material that contains the photosensitive silver halide and/or non-photosensitive source of reducible silver ions it can also mean a layer of the photothermographic material that contains, in addition to the photosensitive silver halide and/or non-photosensitive source of reducible ions, additional essential components and/or desirable additives. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 750 nm.

"Short wavelength visible region of the spectrum" refers to that region of the spectrum from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

An auxochrome is a group of atoms that when conjugated to a chromophore intensifies and/or shifts the color of that chromophore.

"Non-photosensitive" means not intentionally light sensitive.

"Transparent" means capable of transmitting visible light or imaging radiation without appreciable scattering or absorption.

The sensitometric terms "photospeed" or "photographic speed" (also known as "sensitivity"), "contrast", $D_{min}$, and $D_{max}$ have conventional definitions known in the imaging arts.

The density term "mid-tone" or "mid tone density" refers to optical densities of the image in the middle of the of dynamic range of the photothermographic material. It is usually between about 0.5 and 2.0.

As is well understood in this area, for the indolenine, merocyanine, and cyanine compounds defined herein, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group", such as "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy and the like. For example, alkyl group includes ether and thioether groups (for example, $CH_3—CH_2—CH_2—O—CH_2—$ and $CH_3—CH_2—CH_2—S—CH_2—$), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide and others readily apparent to one skilled in the art. Mixtures of silver halides can also be used in any suitable proportion. Silver bromide and silver bromoiodide are more preferred, with the latter silver halide having up to 10 mol % silver iodide. Typical techniques for preparing and precipitating silver halide grains are described in *Research Disclosure*, 1978, Item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies, and may have epitaxial growth of crystals thereon. If desired, a mixture of these crystals may be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example, in U.S. Pat. No. 5,382,504 (Shor et al.). Iridium and/or copper doped core-shell and non-core-shell grains are described in U.S. Pat. No. 5,434,043 (Zou et al.), and U.S. Pat. No. 5,939,249 (Zou), incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example, U.S. Pat. No. 3,839,049 (Simons)]. Materials of this type are often referred to as "preformed soaps".

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8$\mu$m. Those of ordinary skill in the art understand that there is a finite lower practical limit for silver halide grains that is partially dependent upon the wavelengths to which the grains are spectrally sensitized. Such a lower limit, for example, is typically about 0.01 to 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis", ASTM Symposium on Light Microscopy, R. P. Loveland, 1955, pp. 94–122, and in C. E. K. Mees and T. H. James, *The Theory of the Photographic Process*, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.) and U.S. Pat. No. 2,489,341 (Waller et al.)].

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and JP Applications 13224/74, 42529/76, and 17216/75.

In some instances, it may be helpful to prepare the photosensitive silver halide grains in the presence of a hydroxytetrazaindene (such as 4-hydroxy-6-methyl-1,3,3, 3a,7-tetrazaindene) or an N-heterocyclic compound comprising at least one mercapto compound (such as 1-phenyl-5-mercaptotetrazole) to provide increased photospeed. Details of this procedure are provided in and commonly assigned U.S. Ser. No. 09/833,533 (filed Apr. 12, 2001 by Shor, Zou, Ulrich, and Simpson), incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical and Spectral Sensitizing

One or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Chapter 5, pp. 149–169. Suitable conventional chemical sensitization procedures are also described in U.S. Pat. No. 1,623,499 (Sheppard et al.), U.S. Pat. No. 2,399,083 (Wailer et al.), U.S. Pat. No. 3,297,447 (McVeigh), U.S. Pat. No. 3,297,446 (Dunn), U.S. Pat. No. 5,049,485 (Deaton), U.S.

Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915,371 (Lok et al.).

In one embodiment, certain substituted and unsubstituted thiourea compounds can be used as chemical sensitizers. Particularly useful tetra-substituted thioureas are described in U.S. Pat. No. 6,368,779 (Lynch et al.), that is incorporated herein by reference.

Still other useful chemical sensitizers include certain tellurium-containing compounds that are described in and commonly assigned U.S. Ser. No. 09/746,400 (filed Dec. 21, 2000 by Lynch, Opatz, Shor, Simpson, Willett, and Gysling) that is incorporated herein by reference.

Combinations of gold(III)-containing compounds and either sulfur- or tellurium-containing compounds are useful as chemical sensitizers as described in and commonly assigned U.S. Ser. No. 09/768,094 (filed Jan. 23, 2001 by Simpson, Shor, and Whitcomb) that is also incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 $\mu$m. The upper limit can vary depending upon the compound(s) used, the level of silver halide and the average grain size, and it would be readily determinable by one of ordinary skill in the art.

It is preferred that the one or more imaging layers present in the photothermographic materials of this invention have a combined (or total) spectral absorbance of 0.5 or more at a wavelength in the range of from about 750 to about 850 nm. This level of absorbance can be provided by the concentration and/or type of merocyanines, cyanines, indolenine dyes, and other dyestuffs incorporated into or diffused into these layers. The absorbance can be determined using the procedures described in U.S. Pat. No. 5,922,529 (Tsuzuki et al.), Col. 47, incorporated herein by reference. Other useful dyestuffs for this purpose are also described in this reference.

The photothermographic materials of this invention include one or more infrared radiation (IR) sensitive merocyanine or cyanine dyes as spectral sensitizing dyes for the photosensitive silver halide(s). The cyanine dyes include benzothiazole, benzoxazole, and benzoselenazole dyes that include one or more thioalkyl, thioaryl, or thioether groups as defined in more detail below.

The merocyanine dyes useful in the practice of this invention can be represented by the following Structure I:

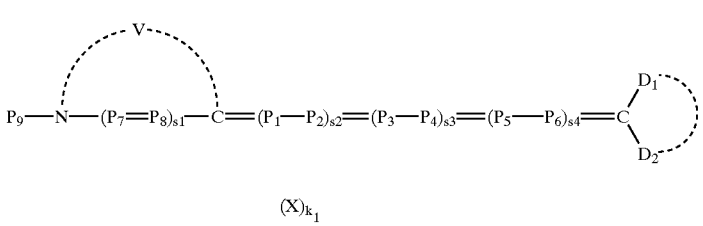

I wherein V is a group of atoms necessary to form a 5- or 6-membered nitrogen containing heterocycle, which may be further fused to carbocyclic or additional heterocyclic rings, $D_1$ and $D_2$ represent the atoms necessary to form an acyclic or cyclic nucleus, $P_9$ is an alkyl, aryl, or alkaryl group, $P_1$, $P_2$, $P_3$, $P_4$, $P_5$, $P_6$, $P_7$, and $P_8$, independently represent a methine group, which may form a ring with another methine group or a ring with an auxochrome, s1, s2, and s3 each are equal to 0 or 1, s4 is 0, 1, or 2, X is an electric charge neutralizing counterion, and $k_1$ is an integer inclusive of 0 necessary to neutralize an electric charge in the molecule.

In formula I, V is a group of atoms necessary to form a 5- or 6-membered nitrogen-containing heterocycle. Examples of the nucleus formed by V include thiazole, benzothiazole, naphthothiazole, thiazoline, oxazole, benzoxazole, naphthoxazole, oxazoline, selenazole, benzoselenazole, naphthoselenazole, selenazoline, tellurazole, benzotellurazole, naphthotellurazole, 3,3-dialkylindolenine, imidazole, benzimidazole, naphthimidazole, and quinoline nuclei. V may be substituted with substituents as described for $P_1$ to $P_8$ below.

Preferred examples of the nucleus formed by V are benzothiazole, naphthothiazole, benzoxazole, naphthoxazole, benzimidazole, 3,3-dialkylindolenine, 2-quinoline, and 4-quinoline nuclei.

$D_1$ and $D_2$ represent the atoms necessary to form an acyclic or cyclic nucleus. In one preferred embodiment, $D_2$ is a thiocarbonyl or carbonyl group and $D_1$ is the remaining atoms necessary to form a carbocyclic or heterocyclic nucleus.

Preferably, $D_1$ and $D_2$, taken together, form a 5- or 6-membered heterocycle consisting of carbon, nitrogen, and chalcogen (typically oxygen, sulfur, selenium, and tellurium) atoms. Preferred examples of the nucleus completed by $D_1$ and $D_2$ include nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,4-dione, isooxazolin-5-one, 2-thiazolin-4-one, thiazolidin-4-one, thiazolidine-2,4-dione, rhodanine, thiazolidine-2,4-dithion, isorhodanine, indane-1, 3-dione, thiophen-3-one, thiophen-3-one-1,1-dioxide, indolin-2-one, indolin-3-one, indazolin-3-one, 2-oxoindazolinium, 3-oxoindazolinium, 5,7-dioxo-6,7-dihydrothiazolo[3,2-a]-pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, and pyrido[1,2-a]pyrimidine-1,3-dione, as well as nuclei having an exo-methylene structure wherein the carbonyl or thiocarbonyl group of the foregoing nuclei is replaced by an active methylene site of an active methylene compound having such a structure as ketomethylene and cyanomethylene. More preferred are nuclei of 3-alkylrhodanine, 3-alkyl-2-thiooxazolidine-2,4-dione, and 3-alkyl-2-thiohydantoin, especially those nuclei having at least one carboxyl group in their molecule.

Preferred examples of substituents attached to any nitrogen atoms contained in the nucleus include a hydrogen atom, alkyl groups of 1 to 18 carbon atoms, preferably 1 to 7 carbon atoms, more preferably 1 to 4 carbon atoms, substituted alkyl groups, such as, aralkyl groups, hydroxyalkyl groups, mercaptoalkyl groups, carboxyalkyl groups, alkoxyalkyl groups, sulfoalkyl groups, sulfatoalkyl groups, heterocycle-substituted alkyl groups, allyl groups, aryl groups, substituted aryl groups, and heterocyclic groups. More preferred substituents are unsubstituted alkyl groups, carboxyalkyl groups, and sulfoalkyl groups.

The nucleus may have substituents attached to any carbon atoms therein, examples of which are as exemplified for the substituent on the polycyclic nucleus of V.

Each of $P_1$, $P_2$, $P_3$, $P_4$, $P_5$, $P_6$, $P_7$, and $P_8$ is a substituted or unsubstituted methine group, which may form a ring with another methine group or a ring with an auxochrome. Exemplary substituents on the methine group include substituted or unsubstituted alkyl groups such as methyl, ethyl, and 2-carboxyethyl, substituted or unsubstituted aryl groups such as phenyl and o-carboxyphenyl, heterocyclic groups such as piperidino, morpholino, diazino, triazino, pyrrolidino, pyridinium, and N-methylpiperazino, thienyl and barbituric acid, halogen atoms such as chlorine and bromine, alkoxy groups such as methoxy and ethoxy, amino groups such as N,N-diphenylamino, N-methyl-N-phenylamino, and alkylthio groups such as methylthio, ethylthio, methylthioethylene, and ethylthioethylene.

In addition, one or more of $P_1$ and $P_2$, $P_2$ and $P_3$, $P_3$ and $P_4$, $P_4$ and $P_5$, and $P_5$ and $P_6$, $P_6$ and $P_3$, $P_2$ and $P_4$, $P_3$ and $P_5$, and $P_4$ and $P_6$, can be joined together to form a 5- to 7-membered ring. Similarly, $P_1$, $P_3$, and $P_5$, and $P_2$, $P_4$, and $P_6$, may be joined to form fused rings that are also preferably 5- to 7-membered rings. Such rings may contain additional substituent groups.

Preferably each $P_1$, $P_2$, $P_3$, $P_4$, $P_5$, $P_6$, $P_7$, and $P_8$ is substituted with hydrogen, a substituted or unsubstituted alkyl group, or comprise adjacent or next adjacent alkyl groups that are joined together to form one or more unsaturated 5- to 6-membered substituted or unsubstituted rings.

$P_9$ is a substituted or unsubstituted alkyl group having 1 to 10 carbon atoms (such as methyl, ethyl, n-propyl, isopropyl, n-hexyl, benzyl, n-butyl, carboxyethyl, carboxybutyl, sulfobutyl, sulfopropyl, —$SO_2$-alkyl groups), an aralkyl group (such as benzyl and diphenylmethylene groups), or substituted or unsubstituted aryl groups having 6 to 10 carbon atoms in the aromatic ring system (such as phenyl, napbthyl, p-methylphenyl, 2,4-ethylphenyl, 2,4-dimethylphenyl, p-chlorophenyl, and 3-methoxyphenyl groups). Other useful alkyl and aryl groups would be readily apparent to one skilled in the art.

Preferably, $P_9$ is a substituted or unsubstituted alkyl group having 1 to 6 carbon atoms, and more preferably, $P_9$ is a substituted or unsubstituted methyl, ethyl, n-propyl, or n-butyl group.

X represents a suitable charge-neutralizing counterion, anion or cation, or combination thereof, and $k_1$ is an integer inclusive of 0 sufficient to neutralize an electric charge in the molecule. Whether a certain dye is a cation or anion, or whether or not a certain dye has a net ionic charge, depends on its structure and substituents. The cation is typically an inorganic or organic ammonium ion or alkali metal ion, including, but not limited to, alkali metal cations, ammonium, alkylammonium, dialkylammonium, trialkylammonium, and tetraalkylammonium. The anion may be either an inorganic or an organic anion, such as halide, alkylsulfonate, arylsulfonate, aryldisulfonate, alkylsulfate, alkylsulfonyl methide and amide, sulfate ion, thiocyanate ion, perchlorate ion, tetrafluoroborate ion, picrate ion, acetate ion, hexafluorophosphate, hexafluoroantimonate and trifluoromethanesulfonate ion. Preferred anions are halide, perchlorate, and p-toluenesulfonate ions. $k_1$ is selected so that the compounds represented in Structure I have a total net charge of zero. Anions having a single negative charge and represented by the formula $X^-$ are preferred.

The merocyanine dyes of formula (I) can be synthesized by the methods described in, for example, F. M. Hamer, *Heterocyclic Compounds—Cyanine Dyes and Related Compounds*, John Wiley & Sons, New York and London, 1964, D. M. Sturmer, *Heterocyclic Compounds—Special Topics in Heterocyclic Chemistry*, Chapter 18, section 4, pp. 482–515, John Wiley & Sons, New York and London, 1977, *Zh. Org. Khim.*, 1981, 17(1), 167–169, 1979, 15(2), 400–407 (1979), 1978, 14(10), 2214–2221, 1977, 13(1), 2440–2443, 1982, 19(10), 2134–2142 (1982), *Ukr. Khim. Zh.*, 1974, 40(6), 625–629, *Khim. Geterotsikl. Soedin.*, 1976, 2, 175–178, Russian Patent Nos. 420,643 and 341,823, JP-A 46930/1974, 217761/1984, and 243944/1991, U.S. Pat. Nos. 4,334,000, 3,671,648, 3,623,881, 3,573,921, and EP 288261A1, 102781A2, and 730008A2.

Representative merocyanine spectral sensitizing dyes useful in this invention are shown below as Compounds I-1 to I-13 wherein X can be any suitable ion. However, the invention is not considered to be limited only to these compounds.

I-1

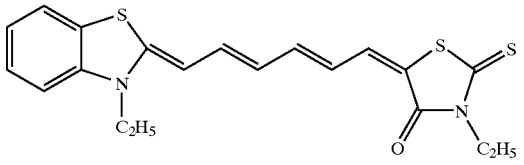

I-2

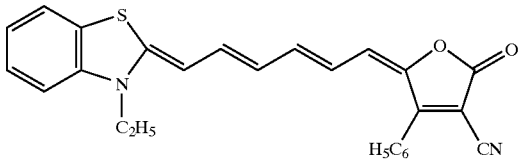

I-3

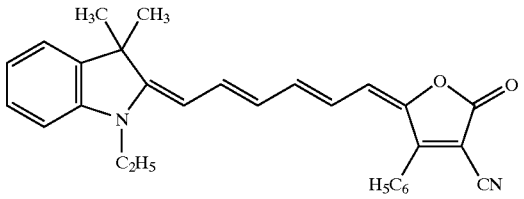

I-4

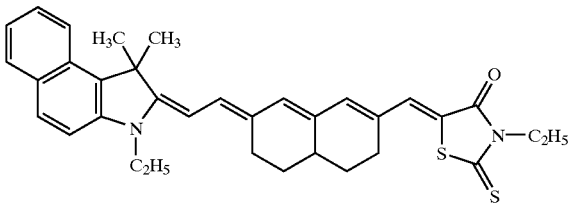

-continued
I-5
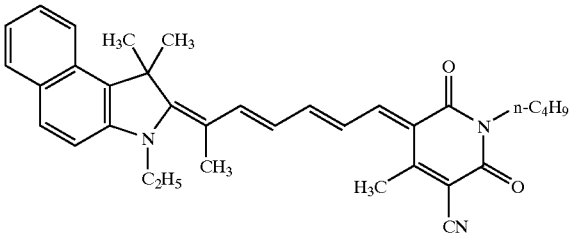
I-6
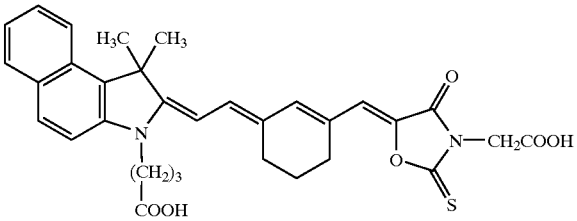
I-7
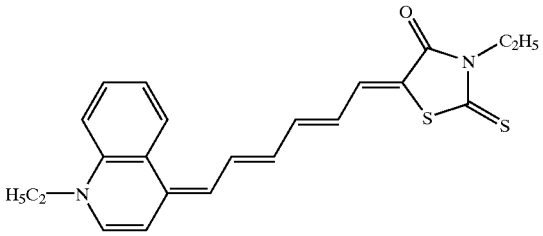
I-8
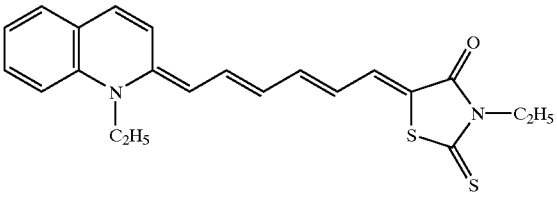
I-9
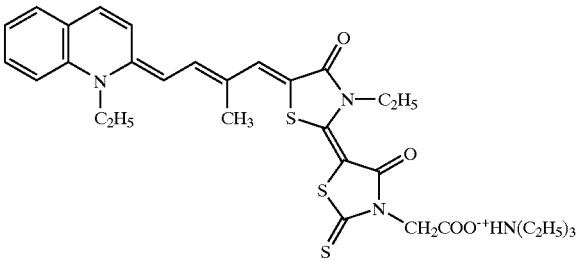
-continued
I-10
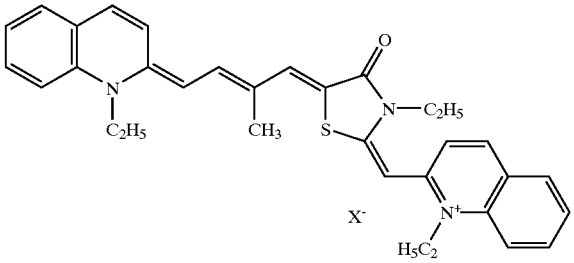
I-11
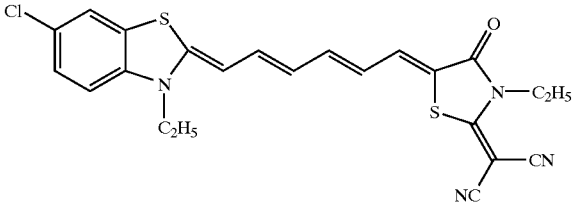
I-12
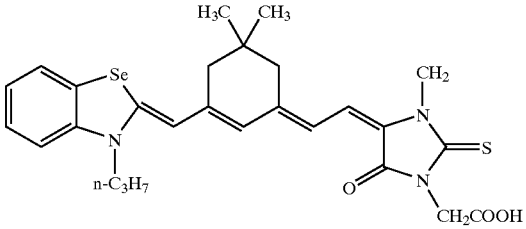
I-13
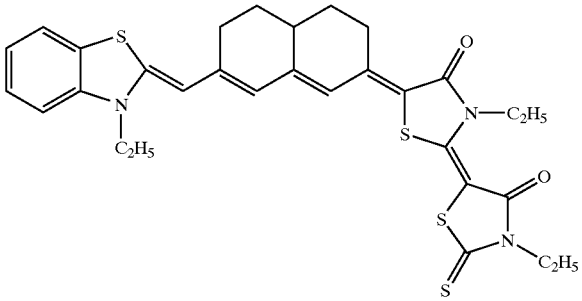
The cyanine dyes useful in the practice of this invention can be represented by the following Structure II:

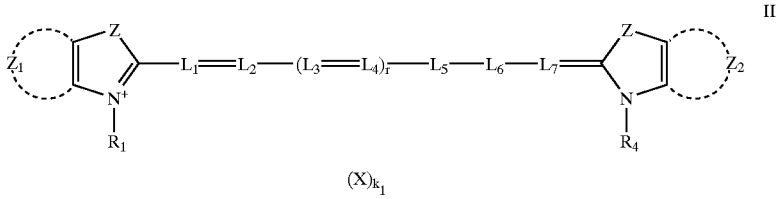

II wherein Z is a thio, oxo, or seleno group. Preferably, Z is a thio group.

In addition, r is 0, 1, or 2, and preferably r is 1.

$Z_1$ and $Z_2$ independently represent four or eight carbon atoms necessary to provide benzo- or naphtho-rings that are condensed with the illustrated N-containing heterocyclic rings. Preferably, each of $Z_1$ and $Z_2$ represents four carbon atoms necessary to provide a condensed benzo-ring. Such fused ring systems include, but are not limited to, benzothiazole, benzoxazole, benzoselenazole, naphthothiazole, naphthoxazole, and naphthoselenazoie ring systems. The benzothiazole ring systems are preferred for both $Z_1$ and $Z_2$.

Either or both of $Z_1$ and $Z_2$ can be substituted with one or more substituents that include, but are not limited to, substituted or unsubstituted alkyl or aryl groups as described below for $R_1$ and $R_4$, halo groups (such as bromo and chloro), substituted or unsubstituted alkoxy groups having 1 to 8 carbon atoms in the alkyl portion of the group (such as methoxy, ethoxy, iso-propoxy, n-butoxy, and n-octyloxy), substituted aryloxy groups having 6 to 10 carbon atoms in the aryl portion of the group (such as phenoxy, p-methylphenoxy, naphthoxy, o-chlorophenoxy, and p-methoxyphenoxy), nitro, —$SO_2$-alkyl, —$SO_2$-aryl, -carboxy, primary, secondary or tertiary amino, —CO-alkyl, —COO-alkyl, —CO-amino, cyano, and —$SO_2$-amino groups. "Alkyl" in these substituents refers to an alkyl group defined as described below for $R_1$ and $R_4$. In addition, "amino" in these substituents refers to a primary amino group as well as secondary and tertiary amino groups that comprise one or two alkyl or aryl groups that are defined the same as $R_1$ and $R_4$. Preferred substituents for $Z_1$ and $Z_2$ are independently chloro, methyl, and methoxy groups.

$R_1$ and $R_4$ are independently substituted or unsubstituted alkyl groups having 1 to 10 carbon atoms (such as methyl, ethyl, n-propyl, iso-propyl, n-hexyl, n-butyl, carboxyethyl, carboxybutyl, sulfobutyl, sulfopropyl, —$SO_2$-alkyl, and phenylmethylene groups) or substituted or unsubstituted aryl groups having 6 to 10 carbon atoms in the aromatic ring system (such as phenyl, naphthyl, p-methylphenyl, 2,4-ethylphenyl, 2,4-dimethylphenyl, p-chlorophenyl, and 3-methoxyphenyl groups). Other useful alkyl and aryl groups would be readily apparent to one skilled in the art.

Preferably, $R_1$ and $R_4$ are independently substituted or unsubstituted alkyl groups having 1 to 6 carbon atoms, and more preferably, they are independently substituted or unsubstituted methyl, ethyl, n-propyl, or n-butyl groups.

$L_1$, $L_2$, $L_3$, $L_4$, $L_5$, $L_6$, and $L_7$, are independently a substituted or unsubstituted methine group. Exemplary substituents on the methine group include substituted or unsubstituted alkyl groups such as methyl, ethyl, and 2-carboxyethyl, substituted or unsubstituted aryl groups such as phenyl and o-carboxyphenyl, heterocyclic groups such as thienyl and barbituric acid, halogen atoms such as chlorine and bromine, alkoxy groups such as methoxy and ethoxy, amino groups such as N,N-diphenylamino, N-methyl-N-phenylamino, and N-methylpiperazino, and alkylthio groups such as methylthio and ethylthio.

Substituents (especially alkyl groups) on adjacent or next adjacent methine groups can be joined together to provide one or more unsaturated 5- to 7-membered substituted or unsubstituted carbocyclic ring within the methine linkage. In addition, $L_1$ and $L_2$, $L_2$ and $L_3$, $L_3$ and $L_4$, $L_4$ and $L_5$, $L_5$ and $L_6$, and $L_6$ and $L_7$, $L_1$ and $L_3$, $L_2$ and $L_4$, $L_3$ and $L_5$, and $L_4$ and $L_6$, and $L_5$ and $L_7$ can be joined together to form a 5- to 7-membered ring. Similarly, $L_1$, $L_3$, and $L_5$, $L_2$, $L_4$, and $L_6$, and $L_3$, $L_5$, and $L_7$ may be joined to form fused rings that are also preferably 5- to 7-membered rings. Such rings may contain additional substituent groups (for example, halogen, methyl, methylthio, phenylthio, or diphenylamino).

Preferably each $L_1$, $L_2$, $L_3$, $L_4$, $L_5$, $L_6$, and $L_7$ is unsubstituted or substituted with a substituted or unsubstituted alkyl group, or comprises adjacent or next adjacent alkyl groups that are joined together to form one or more unsaturated 5- to 6-membered substituted or unsubstituted rings.

In Structure II, it is essential that the cyanine compound have at least one thioalkyl, thioaryl, or thioether group. Such groups can be attached to any one of the $Z_1$, $Z_2$, $R_1$, $R_4$, $L_1$, $L_2$, $L_3$, $L_4$, $L_5$, $L_6$, and $L_7$ groups. There can be multiple thioalkyl, thioaryl, or thioether groups in the molecule if desired. Preferably, such groups are located as a substituent on $Z_1$ and/or $Z_2$.

The thioalkyl groups can have from 1 to 20 carbon atoms in the "alkyl" portion of the group, which alkyl portion can also be substituted if desired, with one or more aryl, alkoxy, hydroxy, halo, thioaryl, or thioalkyl groups. Representative thioalkyl groups include, but are not limited to, thiomethyl, thioethyl, thioisopropyl, thio-n-hexyl, thiobenzyl, thiomethoxymethyl, thio-2-hydroxyethyl, thio-2-cyanoethyl, and thiobutyl groups. Unsubstituted thioalkyl groups having 1 to 6 carbon atoms are preferred.

The thioaryl groups in Structure II can have from 6 to 10 carbon atoms in the "aryl" portion of the group, which aryl portion can be further substituted with one or more alkyl, halo, hydroxy, alkoxy, thioalkyl, or thioaryl groups. Representative thioaryl groups include, but are not limited to, thiophenyl, thio-p-chlorophenyl, thio-3-methoxyphenyl, thionaphthyl, thio-o-methylphenyl, thio-p-carboxyphenyl, and thio-p-(thiomethyl)phenyl groups. Particularly useful thioaryl groups include substituted or unsubstituted thiophenyl groups.

The thioether groups noted above are generally substituent groups that have a thio group between two other groups such as alkyl or aryl groups that can also be substituted, if desired, with one or more alkyl, thioalkyl, thioaryl, alkoxy, aryl, hydroxyalkyl, halo, or hydroxy groups. Such thioether groups include, but are not limited to, alkylenethioalkyl groups, alkylenethioaryl groups, arylenethioaryl groups, and arylenethioalkyl groups, any of which can be substituted as noted above. Particularly useful thioether groups include substituted or unsubstituted alkylenethioalkyl groups (such as substituted or unsubstituted methylenethio-3-n-propyl)

and substituted or unsubstituted alkylenethioaryl groups (such as substituted or unsubstituted 2-ethylenethiophenyl groups). The thioether bond can also be part of a divalent cyclic structure such as a thiophene or thiazolene ring.

Preferably, the cyanine compounds of Structure II comprise one or more unsubstituted thioalkyl groups having 1 to 6 carbon atoms in the alkyl portion of the group.

X represents a suitable charge-neutralizing counterion (anion or cation) or combination thereof, and $k_1$ is an integer inclusive of 0 necessary to neutralize an electric charge in the molecule. Whether a certain dye is a cation or anion or whether or not a certain dye has a net ionic charge depends on its structure and substituents. The cation is typically an inorganic or organic ammonium ion or alkali metal ion, including, but not limited to, alkali metal cations, ammonium, alkylammonium, dialkylammonium, trialkylammonium, and tetraalkylammonium. The anion may be either an inorganic or an organic anion, such as halide, alkylsulfonate, arylsulfonate, aryldisulfonate, alkylsulfate, alkylsulfonyl methide and amide, sulfate ion, thiocyanate ion, perchlorate ion, tetrafluoroborate ion, picrate ion, acetate ion, hexafluorophosphate, hexafluoroantimonate and trifluoromethanesulfonate ion. Preferred anions are halide and p-toluenesulfonate ions. $k_1$ is selected so that the compounds represented in Structure II have a total net charge of zero. Anions having a single negative charge and represented by the formula $X^-$ are preferred.

Preferred benzothiazole spectral sensitizing dyes can be represented by the following Structure II-a:

II-a

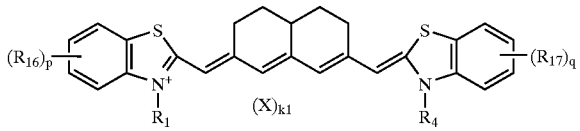

wherein $R_1$ and $R_4$ are independently alkyl or aryl groups (as defined above), $R_{16}$ and $R_{17}$ independently are substituents that independently comprise a thioalkyl, thioaryl, or thioether group (as defined above), p and q are independently 0, 1 or 2, provided that both are not 0, X is a counterion, and $k_1$ is an integer, inclusive of 0 and represents the sum of the counterions. $k_1$ is selected so that the compounds represented in Structure II-a have a total net charge of zero.

Representative cyanine spectral sensitizing dyes useful in this invention are listed below as Compounds II-1 to II-11 wherein X can be any suitable ion. However, the invention is not considered to be limited only to these compounds.

II-1

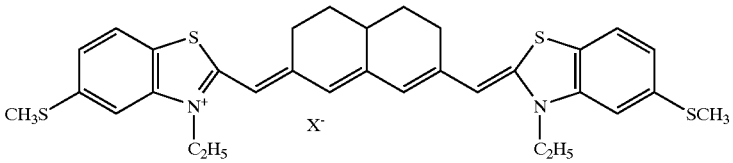

II-2

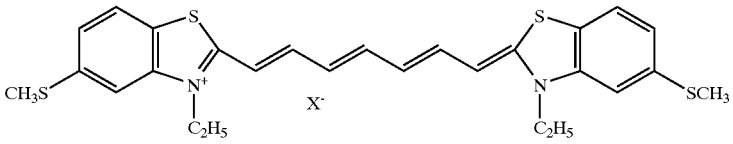

II-3

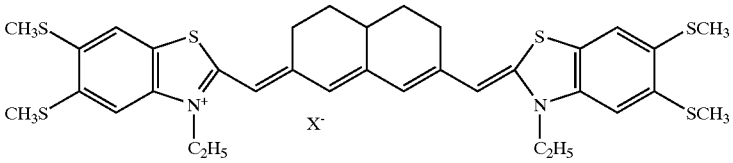

II-4

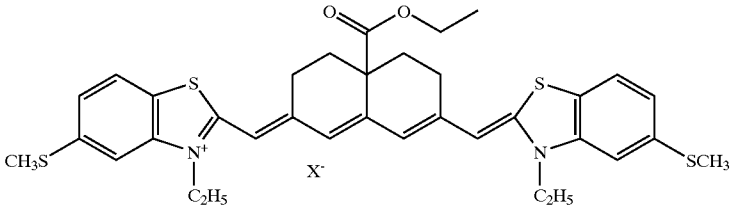

II-5

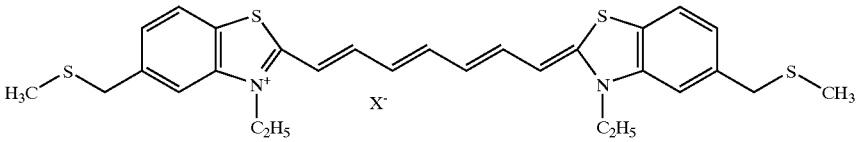

-continued

II-6

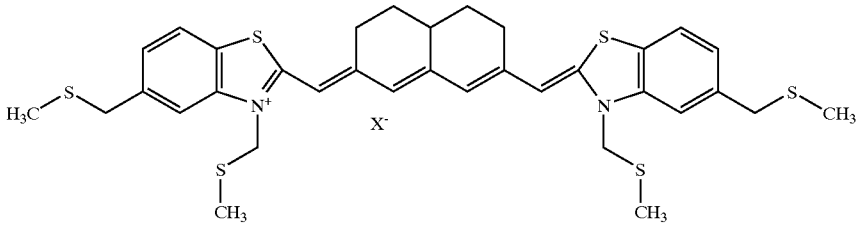

II-7

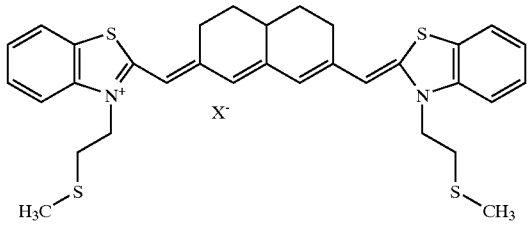

II-8

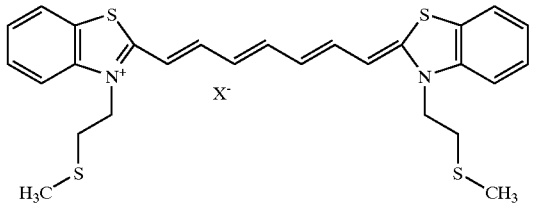

II-9

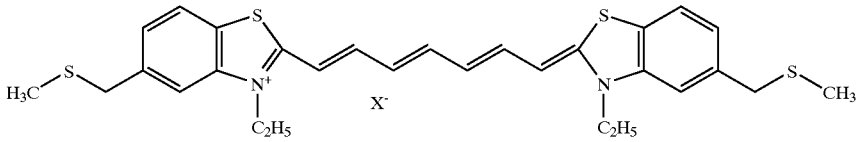

II-10

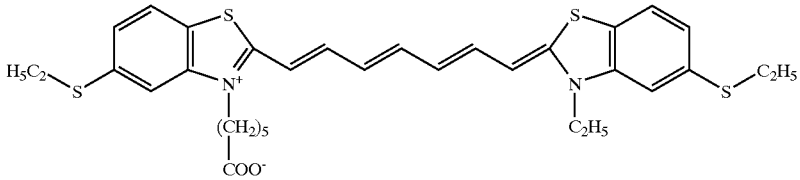

II-11

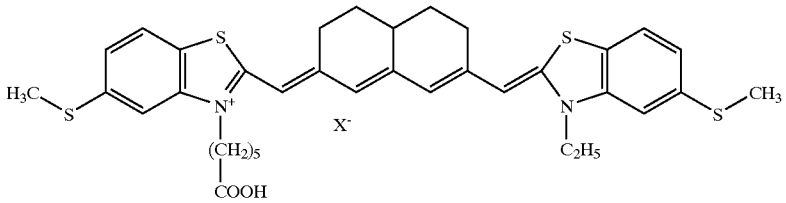

Further details of useful benzothiazole spectral sensitizing dyes are provided in U.S. Pat. No. 5,541,054 (Miller et al.), incorporated herein by reference. These dyes can be prepared by following the teaching in the noted Miller et al. patent as well as the publications noted in Col. 9 thereof.

The spectral sensitizing dyes described herein are present in the photothermographic materials in a "spectrally sensitizing amount" that would be readily apparent to one skilled in the art. An appropriate amount of sensitizing dye added is generally from about $10^{-10}$ to about $10^{-1}$ mole, and preferably, from about $10^{-7}$ to about $10^{-2}$ mole per mole of total silver. The dyes can be present at any higher amount that is limited only by practical considerations of cost and diminishing benefit.

Non-photosensitive Source of Reducible Silver Ions

The non-photosensitive source of reducible silver ions used in photothermographic materials of this invention can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid.

Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used.

Preferred examples of the silver salts of aromatic carboxylic acid and other carboxylic acid group-containing compounds include, but are not limited to, silver benzoate, silver substituted-benzoates, such as silver 3,5-dihydroxybenzoate, silver o-methylbenzoate, silver m-methylbenzoate, silver p-methylbenzoate, silver 2,4-dichlorobenzoate, silver acetarnidobenzoate, silver p-phenylbenzoate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates having hydrocarbon chains incorporating ether or thioether linkages, or sterically hindered substitution in the α- (on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described, for example, in U.S. Pat. No. 4,504,575 (Lee). Silver salts of sulfosuccinates are also useful as described for example, in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example, in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

It is also possible to use what are known as core-shell silver salts as sources of reducible silver ions in the practice of the present invention. Such materials generally comprise one or more silver salts in the "core" of the composition and one or more different silver salts in an outer "shell" of the composition. The various silver salts in either the core or shell can be composed of the various conventional silver salts noted above. Further details of these core-shell silver salts and methods of preparing them are provided in U.S. Pat. No. 6,355,408 (Whitcomb et al.), that is incorporated herein by reference.

Still another useful source of non-photosensitive reducible silver ions in the practice of this invention are the silver dimer compounds that comprise two different silver salts as described in U.S. Ser. No. 09/812,597 (filed Mar. 20, 2001 by Whitcomb) that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

As one skilled in the are would understand, the non-photosensitive source of reducible silver ions can include various mixtures of the various silver salt compounds described herein, in any desirable proportions.

The photocatalyst and the non-photosensitive source of reducible silver ions must be in catalytic proximity (that is, reactive association). "Catalytic proximity" or "reactive association" means that they should be in the same layer, or in adjacent layers. It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of dried photothermographic material, and preferably from about 0.01 to about 0.05 $mol/m^2$ of that material.

The total amount of silver (from all silver sources) in the photothermographic materials is generally at least 0.002 $mol/m^2$ and preferably from about 0.01 to about 0.05 $mol/m^2$.

Reducing Agents

The reducing agent (or reducing agent composition comprising two or more components) for the source of reducible silver ions can be any material, preferably an organic material, that can reduce silver(I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and otherlmaterials readily apparent to one skilled in the art can be used in this manner as described for example, in U.S. Pat. No. 6,020,117 (Bauer et al.).

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes described below.

Hindered phenol reducing agents are preferred (alone or in combination with one or more high contrast co-developing agents and contrast-enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl)methanes, bis (hydroxyphenyl)methanes, and hindered naphthols each of which may be variously substituted.

Representative binaphthols include, but are not limited to, 1,1'-bi-2-naphthol, 1,1'-bi-4-methyl-2-naphthol, and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited to, 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX or PERMANAX WSO), 1,1'-bis(3,5-di-t-butyl-4-hydroxyphenyl)methane, 2,2'-bis (4-hydroxy-3-methylphenyl)propane, 4,4'-ethylidene-bis(2-t-butyl-6-methylphenol) and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems include amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidinohexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl-α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamidophenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.).

Useful co-developer reducing agents can also be used as described for example, in U.S. Ser. No. 09/239,182 (filed Jan. 28, 1999 by Lynch and Skoog), incorporated herein by reference. Examples of these compounds include, but are not limited to, 2,5-dioxo-cyclopentane carboxyaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 3-heteroaromatic-substituted acrylonitrile compounds as described in U.S. Pat. No. 5,635,339 (Murray), 2-substituted malondialdehyde compounds as described in U.S. Pat. No. 5,654,130 (Murray), and 4-substituted isoxazole compounds as described in U.S. Pat. No. 5,705,324 (Murray), 2,5-dioxo-cyclopentane carboxaldehydes, 5-(hydroxymethylene)-1,3-dialkylbarbituric acids, and 2-(ethoxymethylene)-1H-indene-1,3(2H)-diones. Additional developers are described in U.S. Pat. No. 6,100,022 (Inoue et al.). All of the patents noted in this section are incorporated herein by reference.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.).

Yet another class of co-developers are substituted acrylonitrile compounds that can be represented by Structure IV as follows:

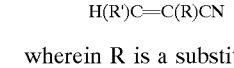

$$H(R')C{=}C(R)CN \qquad IV$$

wherein R is a substituted or unsubstituted aryl group of 6 to 14 carbon atoms in the single or fused ring structure (such as phenyl, naphthyl, p-methylphenyl, p-chlorophenyl, 4-pyridinyl and o-nitrophenyl groups) or an electron withdrawing group (such as a halogen atom, cyano group, carboxy group, ester group and phenylsulfonyl group). R' is a halo group (such as fluoro, chloro and bromo), hydroxy or metal salt thereof, a thiohydrocarbyl group, an oxyhydroxycarbyl group, or a substituted or unsubstituted 5- or 6-membered aromatic heterocyclic group having only carbon atoms and 1 to 4 nitrogen atoms in the central ring (with or without fused rings attached), and being attached through a non-quaternary ring nitrogen atom (such as pyridyl, furyl, diazolyl, triazolyl, pyrrolyl, tetrazolyl, benzotriazolyl, benzopyrrolyl and quinolinyl groups). Further details of these compounds and their preparation can be found in U.S. Pat. No. 5,635,339 (Murray) and U.S. Pat. No. 5,545,515 (Murray et al.), both incorporated herein by reference.

Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene) cyanoacetates and their metal salts.

Various contrast enhancers can be used in some photothermographic materials with specific co-developers. Examples of useful contrast enhancers include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.).

The reducing agent (or mixture thereof described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Other Addenda

The photothermographic materials of the invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae: Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings are also envisioned to be suitable. For example, heteroaromatic mercapto compounds are described as supersensitizers for infrared photothermographic materials in EP-A-0 559 228. (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury(II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), and 2-(tribromomethylsulfonyl) quinoline compounds as described in U.S. Pat. No. 5,460,938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

Particularly useful antifoggants are polyhalo antifoggants, such as those having a $—SO_2C(X')_3$ group wherein X' represents the same or different halogen atoms.

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), compounds having —$SO_2CBr_3$ groups as described for example in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600 589 (Philip, Jr. et al.) and EP-A-0 600 586 (Philip, Jr. et al.), and tribromomethylketones as described, for example, in EP-A-0 600 587 (Oliff et al.).

Preferably, the photothermographic materials include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (Agfa-Gevaert).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+)trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azol idinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate(III), rhodium bromide, rhodium nitrate, and potassium hexachlororhodate(III)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazine and phthalazine derivatives [such as those described in U.S. Pat. No. 6,146,822 (noted above), incorporated herein by reference] are particularly useful toners.

Stabilizing Compounds

It is essential in the practice of this invention that the photothermographic materials comprise one or more indolenine dyes in one or more layers on the frontside of the support as post-processing stabilizing compounds. Such useful indolenine dyes can be represented by the following Structure III:

III

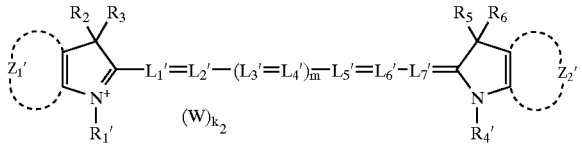

wherein $R_1'$ and $R_4'$ are independently substituted or unsubstituted alkyl groups having 1 to 10 carbon atoms (such as methyl, ethyl, n-propyl, iso-propyl, n-hexyl, n-butyl, carboxyethyl, carboxybutyl, sulfobutyl, sulfopropyl, —$SO_2$-alkyl, and phenylmethylene groups), or substituted or unsubstituted aryl groups having 6 to 10 carbon atoms in the aromatic ring system (such as phenyl, naphthyl, p-methylphenyl, 2,4-ethylphenyl, 2,4-dimethylphenyl, p-chlorophenyl, and 3-methoxyphenyl groups). Other useful alkyl and aryl groups would be readily apparent to one skilled in the art.

Preferably, $R_1'$ and $R_4'$ are independently substituted or unsubstituted alkyl groups having 1 to 10 carbon atoms, and more preferably, they are independently substituted or unsubstituted methyl, ethyl, n-propyl, or n-butyl groups.

$R_2$, $R_3$, $R_5$ and $R_6$ are independently substituted or unsubstituted alkyl groups having 1 to 18 carbon atoms (such as methyl, ethyl, n-propyl, iso-propyl, n-hexyl, n-butyl, benzyl, and iso-butyl) or substituted or unsubstituted aryl groups having 6 to 10 carbon atoms in the aromatic ring system (such as phenyl, naphthyl, p-methylphenyl, 2,4-ethylphenyl, p-chlorophenyl, o-bromophenyl, and p-cyanophenyl). Other useful alkyl and aryl groups would be readily apparent to one skilled in the art.

Preferably, $R_2$, $R_3$, $R_5$ and $R_6$ are independently substituted or unsubstituted alkyl groups having 1 to 6 carbon atoms, and more preferably, they are independently substituted or unsubstituted methyl, ethyl, n-propyl, or n-butyl.

$Z_1'$ and $Z_2'$ independently represent four or eight carbon atoms necessary to provide benzo- or naphtho-rings that are condensed with the illustrated N-containing heterocyclic rings. Preferably, each of $Z_1'$ and $Z_2'$ represents four carbon atoms necessary to provide a condensed benzo-ring.

Either or both of $Z_1'$ and $Z_2'$ can be substituted with one or more substituents that include, but are not limited to, substituted or unsubstituted alkyl or aryl groups as described above for $R_1'$, $R_2$, $R_3$, $R_4'$, $R_5$, and $R_6$, halo groups (such as bromo and chloro), substituted or unsubstituted alkoxy groups having 1 to 8 carbon atoms in the alkyl portion of the group (such as methoxy, 2-ethoxy, iso-propoxy, n-butoxy, and n-hexyloxy), substituted aryloxy groups having 6 to 10 carbon atoms in the aryl portion of the group (such as phenoxy, p-methylphenoxy, naphthoxy, 3-chlorophenoxy, and 2-methoxyphenoxy), nitro, —$SO_2$-alkyl, —$SO_2$-aryl, primary, secondary or tertiary amino, carboxy, —CO-alkyl, —COO-alkyl, —CO-amino, cyano, and —$SO_2$-amino groups. "Alkyl" in these substituents refers to an alkyl group that is defined as described above for $R_1'$. In addition, "amino" in these substituents refers to a primary amino group as well as secondary and tertiary amino groups that comprise one or two alkyl or aryl groups that are defined the same as $R_1'$. Preferred substituents for $Z_1'$ and $Z_2'$ are independently chloro, methyl, and methoxy.

$L_1'$, $L_2'$, $L_3'$, $L_4'$, $L_5'$, $L_6'$, and $L_7'$ independently represent substituted or unsubstituted methine groups. In addition, substituents (especially alkyl groups) on adjacent or next adjacent methine groups can be joined together to provide an unsaturated 5- to 7-membered substituted or unsubstituted carbocyclic ring within the methine linkage. Preferably $L_1'$, $L_2'$, $L_3'$, $L_4'$, $L_5'$, $L_6'$, and $L_7'$ are independently unsubstituted, substituted with a heterocyclyl group, an ether or thioether group, or an alkyl group, or adjacent or next adjacent alkyl groups are joined together to form one or more unsaturated 5- to 6-membered substituted or unsubstituted rings.

Also within Structure III, m is 0, 1 or 2, and preferably m is 1 or 2.

W represents a suitable charge-neutralizing counterion (anion or cation) or combination thereof, and $k_2$ is an integer inclusive of 0 sufficient to neutralize an electric charge in the molecule. Whether a certain dye is a cation or anion or whether or not a certain dye has a net ionic charge depends on its structure and substituents. The cation is typically an inorganic or organic ammonium ion or alkali metal ion, including, but not limited to, alkali metal cations, ammonium, alkylammonium, dialkylammonium, trialkylammonium, and tetraalkylammonium. The anion may be either an inorganic or an organic anion, such as halogen, alkylsulfonate, arylsulfonate, aryldisulfonate, alkylsulfate, alkylsulfonyl methide and amide, sulfate ion, thiocyanate ion, perchlorate ion, tetrafluoroborate ion, picrate ion, acetate ion, hexafluorophosphate, hexafluoroantimonate and trifluoromethanesulfonate ion. $k_2$ is selected so that the compounds represented in Structure III have a total net charge of zero. Preferably W is an anion. Anions having a single negative charge and represented by the formula $W^-$ are preferred. More preferably, W is a perchlorate or tetrafluoroborate anion.

Preferred indolenine dyes can be represented by the following Structure III-a:

III-a

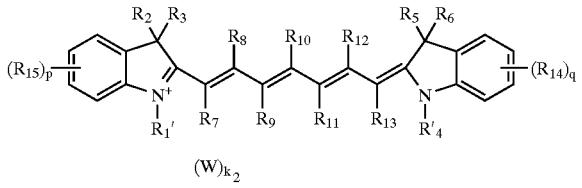

wherein $R_1'$, $R_2$, $R_3$, $R_4'$, $R_5$ and $R_6$ are independently alkyl or aryl groups (as defined above), $R_7$, $R_8$, $R_9$, $R_{10}$, $R_{11}$, $R_{12}$, $R_{13}$, $R_{14}$, and $R_{15}$ are independently substituted or unsubstituted alkyl, aryl, alkoxy, aryloxy, alkyl(or aryl)—$SO_w$—, halo, secondary or tertiary amino, heterocyclyl, alkyl(or aryl)—CO—, alkyl(or aryl)—COO, R"R'"NCO—, nitro, cyano, or R"R'"$NSO_2$— groups, R" and R'" are independently substituted or unsubstituted alkyl or aryl groups or can be joined together to form a 5- or 6-membered heterocyclic ring, w is 0, 1 or 2, any of $R_1'$ and $R_7$, $R_7$ and $R_8$, $R_8$ and $R_9$, $R_9$ and $R_{10}$, $R_{10}$ and $R_{11}$, $R_{11}$ and $R_{12}$, $R_{12}$ and $R_{13}$, $R_{13}$ and $R_4'$, $R_7$ and $R_9$, $R_8$ and $R_{10}$, $R_9$ and $R_{11}$, $R_{11}$ and $R_{12}$, and $R_{11}$ and $R_{13}$ can be joined together to form a 5- or 6-membered ring, W is a suitable counterion, and $k_2$ is an integer, including 0 and is selected so that the compounds represented in Structure III-a have a total net charge of zero. Similarly, $R_7$, $R_9$, and $R_{11}$, $R_8$, $R_{10}$ and $R_{12}$, and $R_9$, $R_{11}$, and $R_{13}$, may be joined to form fused rings that are also preferably 5- or 6-membered rings consisting of carbon atoms. Such rings may contain additional substituent groups (for example, halogen, methyl, methylthio, phenylthio, or diphenylamino).

In a preferred embodiment, $R_9$ and $R_{11}$ are joined to form a 5- or 6-membered ring. In another preferred embodiment, any of $R_7$, $R_8$, $R_9$, $R_{10}$, $R_{11}$, $R_{12}$, or $R_{13}$, is a heterocycyl group, such as piperidino, morpholino, diazino, triazino, pyrrolidino, pyridinium, and N-methylpiperazino, diazolo, triazolo, thienyl, and barbituric acid, or a thioether group.

Representative indolinene dyes useful in the practice of this invention are the following compounds III-1 to III-27 wherein $W^-$ represents any suitable anion, but the invention is not intended to be limited to only these compounds:

III-1

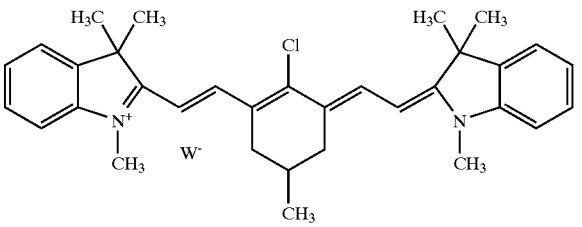

III-2

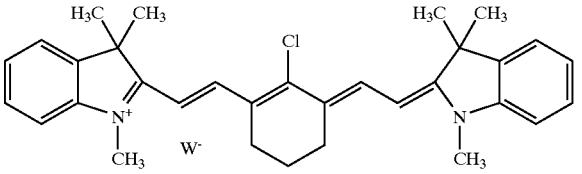

-continued
III-3
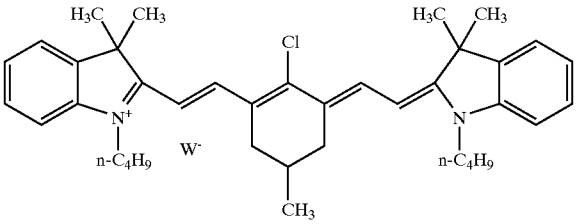
III-4
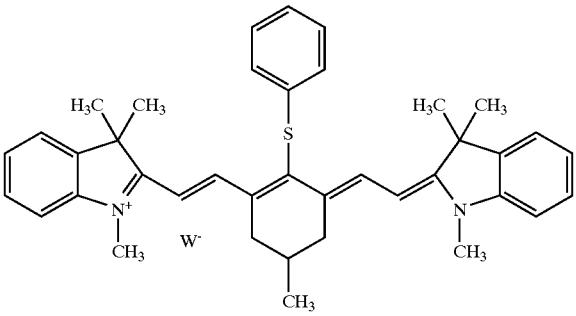
III-5
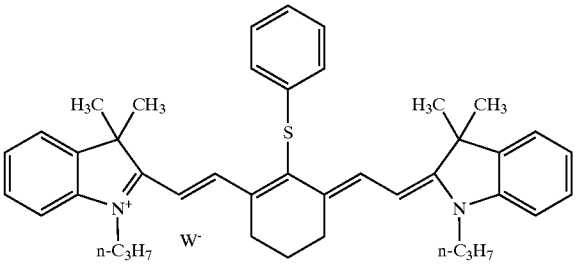
III-6
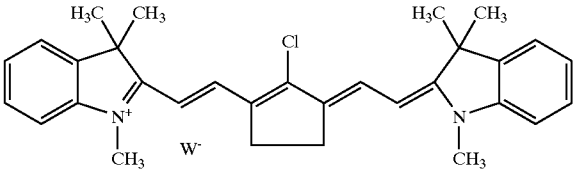
III-7
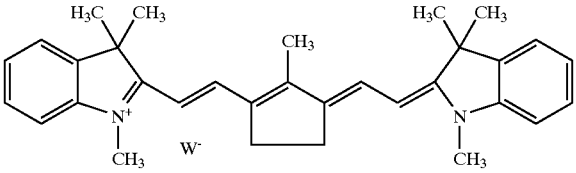
III-8
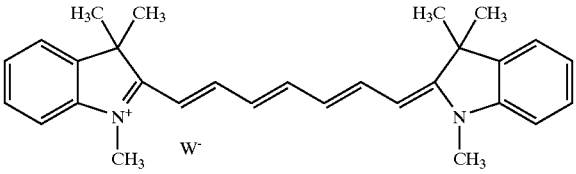
-continued
III-9
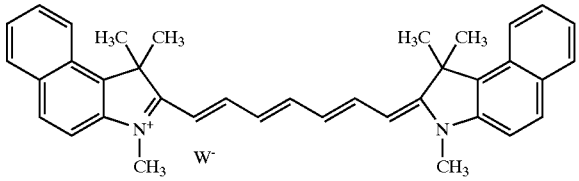
III-10
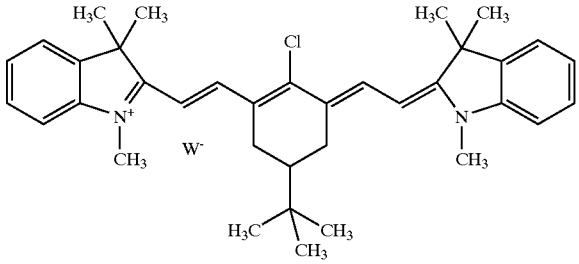
III-11
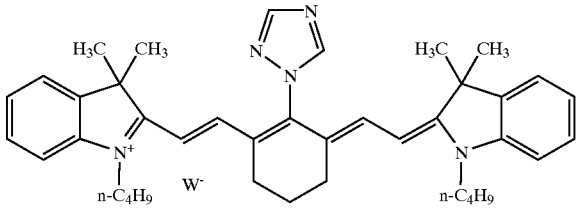
III-12
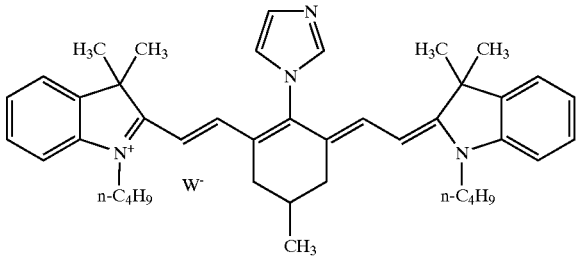
III-13
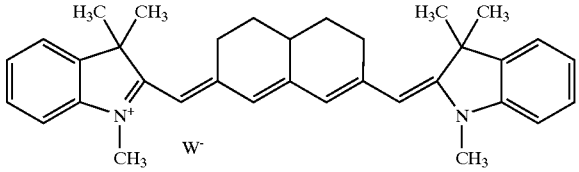
III-14
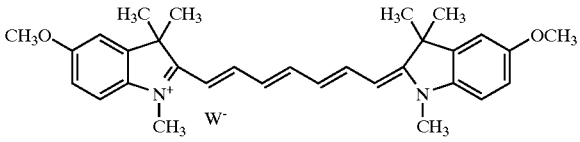

-continued
III-15
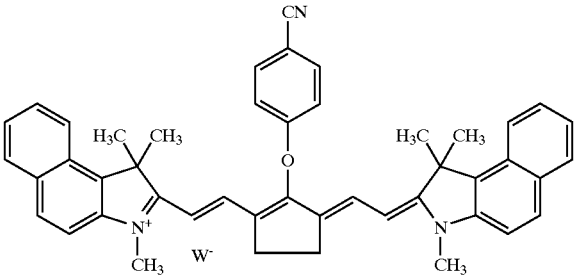
III-16
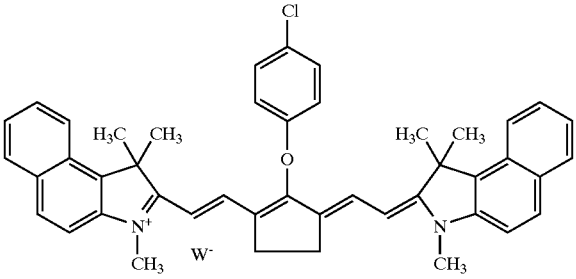
III-17
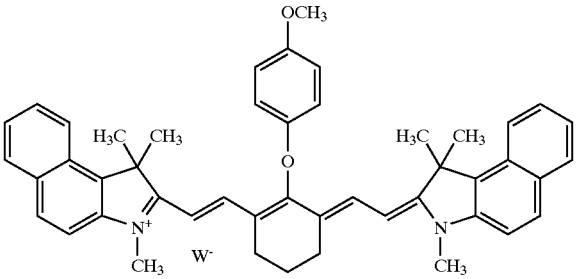
III-18
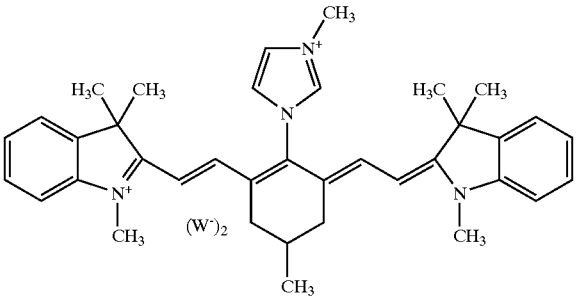
III-19
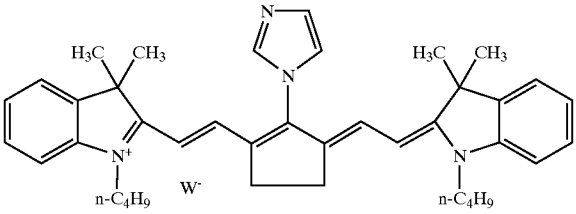
-continued
III-20
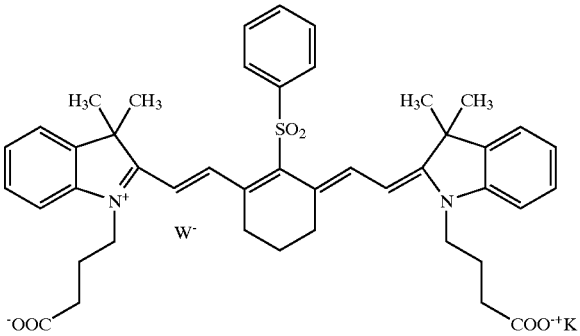
III-21
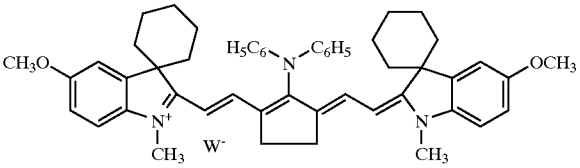
III-22
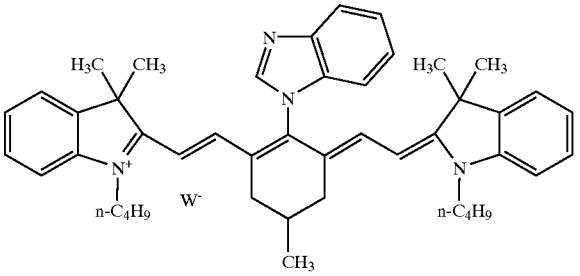
III-23
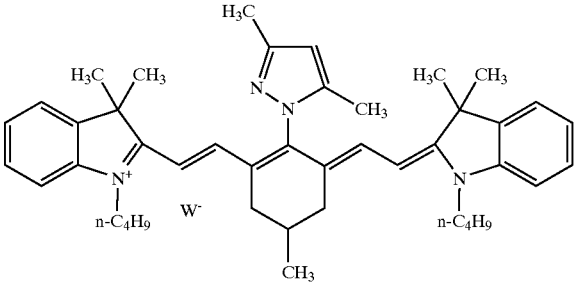
III-24
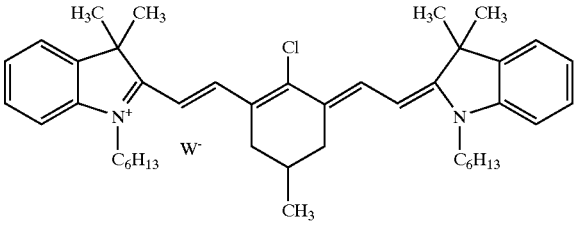
III-25
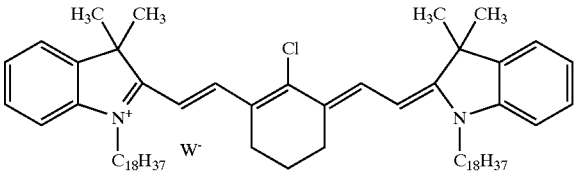

-continued

III-26

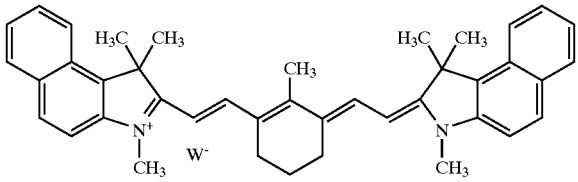

III-27

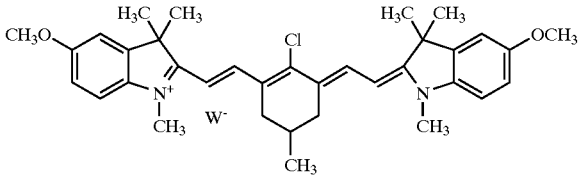

The indolenine dyes useful in the practice of this invention can be synthesized as described, for example, in EP-A-342 810 (Leichter) and U.S. Pat. No. 5,258,282 (Kagami et al.), both incorporated herein by reference, and in the publications described therein.

The indolenine dyes described herein can be present in the photothermographic materials individually or in mixtures of two or more. Generally, the one or more indolenine dyes are present in an amount of at least $10^{-6}$ and preferably at least $10^{-5}$ moles per square meter of the photothermographic material. The upper limit of the amount of one or more indolenine dyes is whatever may be practical based on tint, photographic speed and other considerations that would be readily apparent to one skilled in the art.

While the indolenine dyes just described can be in any frontside layer of the photothermographic materials of this invention, preferably, they are in one or more imaging layer(s) or allowed to diffuse into such layers. It is also preferred that they be in the same layer as the merocyanine or cyanine spectral sensitizing dyes described above.

The procedure and timing for incorporating the indolenine dyes into the photothermographic materials of this invention are not limited. For example, they can be formulated directly (with or without solvent) within one or more imaging layer formulations that are coated and dried as described herein. Alternatively and preferably, they are incorporated into a topcoat or other layer formulation that is applied to the one or more imaging layers. Such incorporated dyes tend to migrate or diffuse into the one or more imaging layers prior to imaging and heat-development. Still again, a dried photothermographic material can be dipped into a solvent solution (such as methyl ethyl ketone solution) of an indolenine dye that will diffuse into the material.

Binders

The photocatalyst (such as photosensitive silver halide), the non-photosensitive source of reducible silver ions, the reducing agent composition, and any other additives used in the present invention are generally added to one or more binders that are either hydrophilic or hydrophobic. Thus, either aqueous or solvent-based formulations can be used to prepare the photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR®B79 (Solutia, Inc.) and Pioloform BS-18 or Pioloform BL-16 (Wacker Chemical Company). Aqueous dispersions (or latexes) of hydrophobic binders, may also be used.

Examples of useful hydrophilic binders include, but are not limited to, gelatin and gelatin-like derivatives (hardened or unhardened), cellulosic materials such as hydroxymethyl cellulose, acrylamide/methacrylamide polymers, acrylic/methacrylic acid polymers polyvinyl pyrrolidones, polyvinyl alcohols and polysaccharides (such as dextrans and starch ethers).

Hardeners for various binders may be present if desired. Useful hardeners are well known and include diisocyanate compounds as described for example, in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure*, August 1979, item 1843 1. A method of making dimensionally stable polyester films is described in *Research Disclosure*, September 1999, item 42536.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Support materials may also be treated or annealed to reduce shrinkage and promote dimensional stability.

Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone (methyl ethyl ketone), acetone or tetrahydrofuran.

Alternatively, these components can be formulated with a hydrophilic binder in water or water-organic solvent mixtures to provide aqueous-based coating formulations.

Phototbermographic materials of the invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and image density uniformity as described in U.S. Pat. No. 5,468,603 (Kub).

EP-A-0 792 476B1 (Geisler et al.) describes various means of modifying the photothermographic materials to reduce what is known as the "woodgrain" effect, or uneven image density. This effect can be reduced or eliminated by several means, including treatment of the support, adding matting agents to the topcoat, using acutance dyes in certain layers, or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in photothermographic materials are also known, as described for example, in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example, in U.S. Pat. No. 5,928,857 (Geisler et al.).

Layers to reduce emissions from the film may also be present, including the polymeric barrier layers described in U.S. Pat. No. 6,352,819 (Kenney et al.) and U.S. Pat. No. 6,352,820 (Bauer et al.), both incorporated herein by reference.

Photothermographic formulations described can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittnan et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers, described above, may be used. Such formulations are described in U.S. Pat. No. 6,355,405 (Ludeman et al.).

Mottle and other surface anomalies can be reduced in the materials of this invention by incorporation of a fluorinated polymer as described for example, in U.S. Pat. No. 5,532,121 (Yonkonski et al.) or by using particular drying techniques as described, for example, in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, a manufacturing method can also include forming on the opposing or backside of said polymeric support, one or more additional layers, including an antihalation layer, an antistatic layer, or a layer containing a matting agent (such as silica), or a combination of such layers. It is also contemplated that the photothermographic materials of this invention can include emulsion layers on both sides of the support.

In preferred embodiments, the photothermographic materials of this invention include a surface protective layer on the same side of the support as the one or more thermally-developable layers, an antihalation layer on the opposite side of the support, or both a surface protective layer and an antihalation layer on their respective sides of the support.

To promote image sharpness, photothermographic materials according to the present invention can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation coating on the support opposite to the side on which the emulsion and topcoat layers are coated.

Dyes particularly useful as antihalation and acutance dyes include dihydroperimidine squaraine dyes having the nucleus represented by the following general structure:

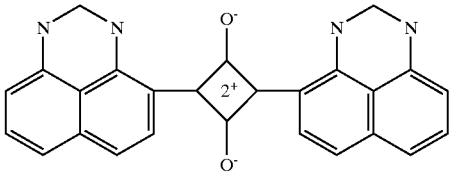

Details of such dyes having the dihydroperimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt).

The indolenine dyes described above that are useful as post-processing stabilizing compounds on the frontside of the support can also act as acutance dyes. Moreover, they can further be used as antihalation dyes in a backside layer of the photothermographic materials. A preferred compound used in this manner is 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate (Dye III-1).

It is also useful in the present invention to employ acutance or antihalation dyes that will decolorize with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), and EP-A-0 911 693 (Sakurada et al.).

Imaging/development

While the imaging materials of the present invention can be imaged in any suitable manner consistent with the type of material using any suitable imaging source (typically some type of radiation or electronic signal), the following discussion will be directed to the preferred imaging means. Generally, the materials are sensitive to radiation in the range of at least 700 nm, and preferably from about 750 to about 850 nm.

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, September 1996, item 38957, (such as sunlight, xenon lamps and fluorescent lamps). Particularly useful exposure means uses laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50 to about 250° C. (preferably from about 80 to about 200° C. and more preferably from about 100 to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example, at about 150° C. for up to 10 seconds), followed by thermal diffusion at a lower temperature (for example, at about 80° C.) in the presence of a transfer solvent.

Use as a Photomask

The photothermographic materials of the present invention are sufficiently transmissive in the range of from about 350 to about 450 nm in non-imaged areas to allow their use in a process where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

The following examples are provided to illustrate the practice of this invention, and are not intended to be limiting in any manner. The examples provide exemplary synthetic and preparatory procedures using the indolenine post-processing stabilizing compounds within the scope of the present invention.

Materials and Methods for the Examples

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID™A-21 or PARALOID A-21 is an acrylic copolymer available from Rohm and Haas (Philadelphia, Pa.).

BUTVAR®B-79 is a polyvinyl butyral resin available from Solutia, Inc. (St. Louis, Mo.).

CAB 171-15S is a cellulose acetate butyrate resin available from Eastman Chemical Co (Kingsport, Tenn.).

DESMODUR®N3300 is an aliphatic hexamethylene diisocyanate available from Bayer Chemicals (Pittsburgh, Pa.).

LOWINOX 221B446 is 2,2'-isobutylidene-bis(4,6-dimethylphenol) available from Great Lakes Chemical (West Lafayette, Ind.).

PERMANAX WSO (or NONOX) is 1,1'-bis(2-hydroxy-3,5-dimethylphenyl)-3,5,5-trimethylhexane and is available from St-Jean PhotoChemicals, Inc. (Quebec, Canada).

PIOLOFORM BL-16 and BS-18 are apolyvinyl butyral resins available from Wacker Polymer Systems (Adrian, Mich.).

MEK is methyl ethyl ketone (or 2-butanone).

Comparative Sensitizing Dye A (CSD-A) is

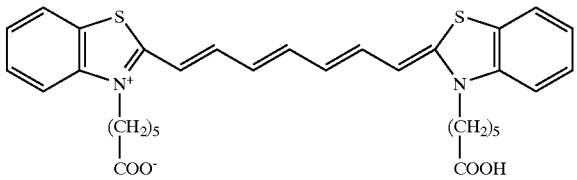

Vinyl Sulfone-1 (VS-1) is described in U.S. Pat. No. 6,143,487 and has the following structure:

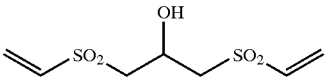

Antifoggant A is 2-(tribromomethylsulfonyl)quinoline and has the following structure:

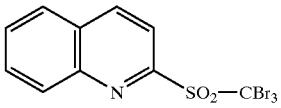

Antifoggant B is ethyl-2-cyano-3-oxobutanoate and has the structure shown below.

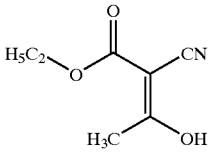

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

BC-1

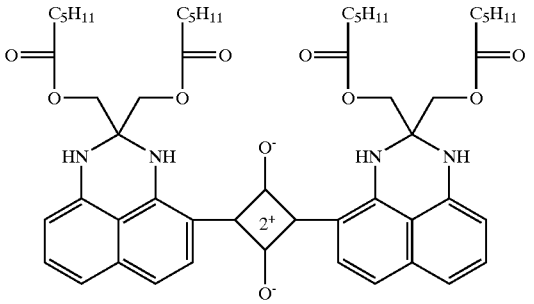

EXAMPLE 1

A photothermographic imaging formulation was prepared as follows:

A preformed silver halide, silver carboxylate soap dispersion, prepared as described in U.S. Pat. No. 5,939,249 (noted above), was homogenized to 28.1% solids in MEK containing Pioloform BS-18 polyvinyl butyral binder (4.4% solids). Three formulations, X, Y, and Z, were prepared, each having 230 parts of the above emulsion. To each formulation was added 1.89 parts of a 15% solution of pyridinium hydrobromide perbromide in methanol, with stirring. After 60 minutes of mixing, 2.5 parts of an 11% zinc bromide solution in methanol was added to each batch. Stirring was continued and after 30 minutes, an addition to each batch was made of a solution of 0.18 parts 2-mercapto-5-methylbenzimidazole, the sensitizing dye described below in TABLE I, 2.0 parts of 2-(4-chlorobenzoyl)benzoic acid, 12.9 parts of methanol, and 4.5 parts of MEK. After stirring for 45 minutes, the temperature was lowered to 10° C. After stirring for another 35 minutes, 48.9 parts of Pioloform BL-16 was added to each batch. Mixing was continued for another 30 minutes.

TABLE I

| Formula | Sensitizing Dye | Amount |
|---|---|---|
| X | CSD-A | 0.006 parts |
| Y | II-1, X = $I^-$ | 0.008 parts |
| Z | II-12 | 0.005 parts |

The formulations were completed by mixing for 5 minutes between the addition of the following components to each batch:

| | |
|---|---|
| Antifoggant A | 1.55 parts |
| Tetrachlorophthalic acid | 0.44 parts |
| 4-Methylphthalic acid | 0.71 parts |
| MEK | 24.7 parts |
| Methanol | 0.43 parts |
| LOWINOX 221B446 | 11.4 parts |
| DESMODUR ® N3300 | 0.79 parts in 0.39 parts MEK |
| Phthalazine | 1.59 parts in 7.5 parts MEK |

Topcoat Formulation:

A topcoat formulation was prepared by mixing the following ingredients:

| | |
|---|---|
| ACRYLOID A-21 | 0.76 parts |
| CAB 171-15S | 19.7 parts |
| MEK | 226 parts |
| Vinyl sulfone VS-1 | 0.57 parts |
| Benzotriazole | 0.43 parts |
| Antifoggant B | 0.38 parts |

The topcoat was finished as two different formulations, one without dye (a control), and one with indolenine dye III-5. For the control, 11.9 parts MEK was added to 58 parts of the topcoat formulation. For the dye containing formulation, a solution consisting of 11.9 parts MEK and 0.064 parts indolenine dye III-5 was added to 58 parts of the topcoat above.

Four photothermographic materials were coated from the three imaging (silver) formulations and two topcoat formulations. They are listed below TABLE II.

TABLE II

| Material | Silver Formulation | Topcoat Formulation |
|---|---|---|
| Control A | X (CSD-A) | no dye |
| ComparisonA | X (CSD-A) | Dye III-5* |
| Example 1b | Y (Dye II-1) | Dye III-5* |
| Example 1c | Z (Dye II-12) | Dye III-5* |

*The counterion is perchlorate

The imaging (silver) and topcoat formulations were simultaneously coated onto a 178 $\mu$m polyethylene terephthalate film to provide photothermographic materials of this invention. The silver containing solution was coated to obtain about 2 g of silver/m$^2$. The topcoat solution was coated to obtain about 0.24 g/ft$^2$ (2.6 g/m$^2$) dry coating weight. For samples using the dyed topcoat, this corresponds to about 43 1mol/m$^2$ of dye III-5. Immediately after coating, samples were dried in a forced air oven at between 77 and 99° C. for between 4 and 5 minutes.

The backside of the support had been coated with an antihalation layer having an absorbance greater than 0.3 between 805 and 815 nm.

Each photothermographic material was cut into strip samples, exposed with a laser sensitometer at 810 nm, and heat-developed for 15 seconds at 124° C. to generate continuous tone wedges with image densities varying from a minimum density ($D_{min}$) to an image density greater than 3.5. These wedges were then measured with a computer densitometer to obtain graphs of density verses log exposure (that is, D log E curves). The "speed" of the film was then calculated as 4 minus the log of the exposure required to achieve a density of 1.0 above $D_{min}$. The results, shown below in TABLE III, as Speed Improvement Relative to Control A, represent the speed improvement (Δ Speed) of Comparison A Sample, Sample 1b, and Sample 1c, over Sample Control A. The positive number indicates greater photosensitivity of Comparison A Sample, Sample 1b, and Sample 1c when compared with Control A.

One or two wedge samples of each photothermographic material were then illuminated with fluorescent lighting (90–120 footcandles or 970–1290 Lux) for 4 hours at 21° C./50% relative humidity in an environmental room. Each sample was then scanned using a densitometer that records optical density along the sample every 0.25 mm. The densitometer was configured with a blue filter in the status A mode.

The samples were then stacked together and bagged tightly in a high-density, flat-black polyethylene bag. A strip of polyethylene terephthalate was placed on each side of the stack of film samples. The bagged samples were placed in a hot oven and heated at 68–74° C. for 3 hours. Upon cooling to room temperature, the samples were removed from the bag and rescanned with the same densitometer identically configured.

For each sample, the change in image density resulting from heat treatment was calculated. The density change in the $D_{min}$ region is reported below in TABLE III as "$\Delta D_{min}$". The maximum change in density found anywhere in the sample is reported as "Peak Δ". For good stability, it is desirable to minimize these density changes.

The % improvement in both $\Delta D_{min}$ and Peak Δ for each sample were also compared to that of Sample Control A. These comparisons are recorded below in TABLE III as % Improvement in $\Delta D_{min}$ and % Improvement in Peak Δ. In these samples, the more negative the number, the greater the improvement in heat-stability compared to Control A.

The results, shown below in TABLE III, demonstrate that photothermographic materials within the scope of this invention have improved photosensitivity and image stability. Comparison A shows that although some stability improvement can be gained with an indolenine dye alone, no speed improvement is achieved. Invention Examples 1b and 1c show that to obtain both improved stability and sensitivity, the presence of both an appropriate sensitizing dye and an indolenine dye are required.

TABLE III

| Material | Silver Formulation | Topcoat Formulation | Speed Improvement Relative to Control A | $\Delta D_{min}$ | % Improvement in $\Delta D_{min}$ | Peak Δ | % Improvement in Peak Δ |
|---|---|---|---|---|---|---|---|
| Control A | X | no dye | | 0.10 | | 1.8 | |
| Comparison A | X | Dye III-5* | 0.0 | 0.09 | −10% | 1.5 | −17% |
| Example 1b | Y | Dye III-5* | 0.9 | 0.07 | −30% | 1.0 | −44% |
| Example 1c | Z | Dye III-5* | 0.3 | 0.08 | −20% | 1.3 | −28% |

*The counterion is perchlorate

EXAMPLE 2

A preformed silver halide, silver carboxylate soap dispersion prepared as described in U.S. Pat. No. 5,939,249 (noted above), was homogenized to 28.1% solids in MEK containing Pioloform BS-18 polyvinyl butyral binder (4.4% solids). To 230 parts of this emulsion was added 1.89 parts of a 15% solution of pyridinium hydrobromide perbromide in methanol, with stirring. After 60 minutes of mixing, 2.5 parts of an 11% zinc bromide solution in methanol was added. Stirring was continued and after 30 minutes, an addition to the batch was made of a solution of 0.18 parts 2-mercapto-5-methylbenzimidazole, 0.0081 parts dye II-1, iodide, 2.0 parts of 2-(4-chlorobenzoyl)benzoic acid, 12.9 parts of methanol, and 4.5 parts of MEK. After stirring for 45 minutes, the temperature of the formulation was lowered to 10° C. After stirring for another 35 minutes, 49.2 parts of Pioloform BL-16 was added immediately followed by 4.3 parts of MEK. Mixing was continued for another 30 minutes.

The formulation was completed by mixing for 5 minutes between the additions of the following components:

| | |
|---|---|
| A solution of: | |
| Antifoggant A | 1.55 parts Antifoggant A |
| Tetrachlorophthalic acid | 0.44 parts |
| 4-Methylphthalic acid | 0.71 parts |
| MEK | 17.7 parts |
| Methanol | 0.41 parts |
| LOWINOX 221B446 | 11.4 parts |
| A solution of | |
| DESMODUR ® N3300 | 0.79 parts |
| MEK | 0.39 parts |
| A solution of: | |
| Phthalazine | 1.59 parts |
| MEK | 7.5 parts |

Protective Topcoat Formulation:

A protective topcoat for the photothermographic formulation layer was prepared as follows:

| | |
|---|---|
| ACRYLOID A-21 | 1.2 parts |
| CAB 171-15S | 30.6 parts |
| MEK | 192 parts |
| Vinyl sulfone VS-1 | 0.89 parts |
| Benzotriazole | 0.66 parts |
| Antifoggant B | 0.59 parts |
| Sylysia 310 | 0.52 parts |

Four aliquots of the above topcoat were completed at different levels of indolenine dye III-1, perchlorate. The levels were 0.6x, 0.8x, 1.0x, 1.2x, 1.4x, and 1.6x. For each case, to 22.7 parts of the topcoat described above, a solution was added consisting of 2.2 parts MEK and the appropriate amount of indolenine dye III-1, where 1.0x corresponds to 0.053 parts, and other levels were added in proportion.

A topcoat for the Control B photothermographic material was similarly prepared except that no indolenine dye was included.

The imaging and topcoat formulations were coated simultaneously onto a 178 μm polyethylene terephthalate film using a slide coater to provide photothermographic materials of this invention. The silver containing solution was coated to obtain a dry coating weight of about 2 g of silver/$m^2$. The topcoat solution was coated to obtain a dry coating weight of about 0.24 g/$ft^2$ (2.6 g/$m^2$). The 1X dye level corresponds to about 65 μmole per square meter. Immediately after coating, samples were dried in a forced air oven at between 77 and 99° C. for between 4 and 5 minutes.

The backside of the support had been coated with an antihalation layer having an absorbance greater than 0.3 between 805 and 815 nm.

Each photothermographic material was cut into strip samples, exposed with a conventional laser sensitometer at 810 nm, and heat-developed for 15 seconds at 124° C. to generate continuous tone wedges with image densities varying from the minimum density ($D_{min}$) to an image density greater than 3.5.

One or two wedge samples of each photothermographic material were selected and illuminated with fluorescent lighting (90–120 footcandles or 970–1290 Lux for 6 hours at 21° C./50% relative humidity in an environmental room. Each sample was then scanned using a densitometer that takes an optical density reading of the sample every 0.25 mm. The densitometer was configured with a blue filter in the status A mode.

The samples were stacked together and bagged tightly in a high-density, flat-black polyethylene bag. A strip of polyethylene terephthalate was placed on each side of the stack of film samples. The bagged samples were placed in a hot oven and heated at 68–74° C. for 2.5 hours. After the samples were cooled to room temperature, they were removed from the bag and rescanned with the same densitometer.

From the densitometer data that was collected, the change in image density along the D log E curve that occurred upon heat treatment was plotted against the image density before heat treatment. FIG. 1 shows a plot of this data. This plot shows the improvement in post-processing image stability at various densities along the D log E curve. Curve B represents the data for the Control B material containing no indolenine dye. Curves C and D represent the data for photothermographic materials of this invention also comprising 0.8x and 1.6x, respectively, of indolenine dye III-1. It is evident from these data that the presence of an indolenine dye in the photothermographic material improves high-temperature, post-processing stability.

EXAMPLE 3

Figure 2:
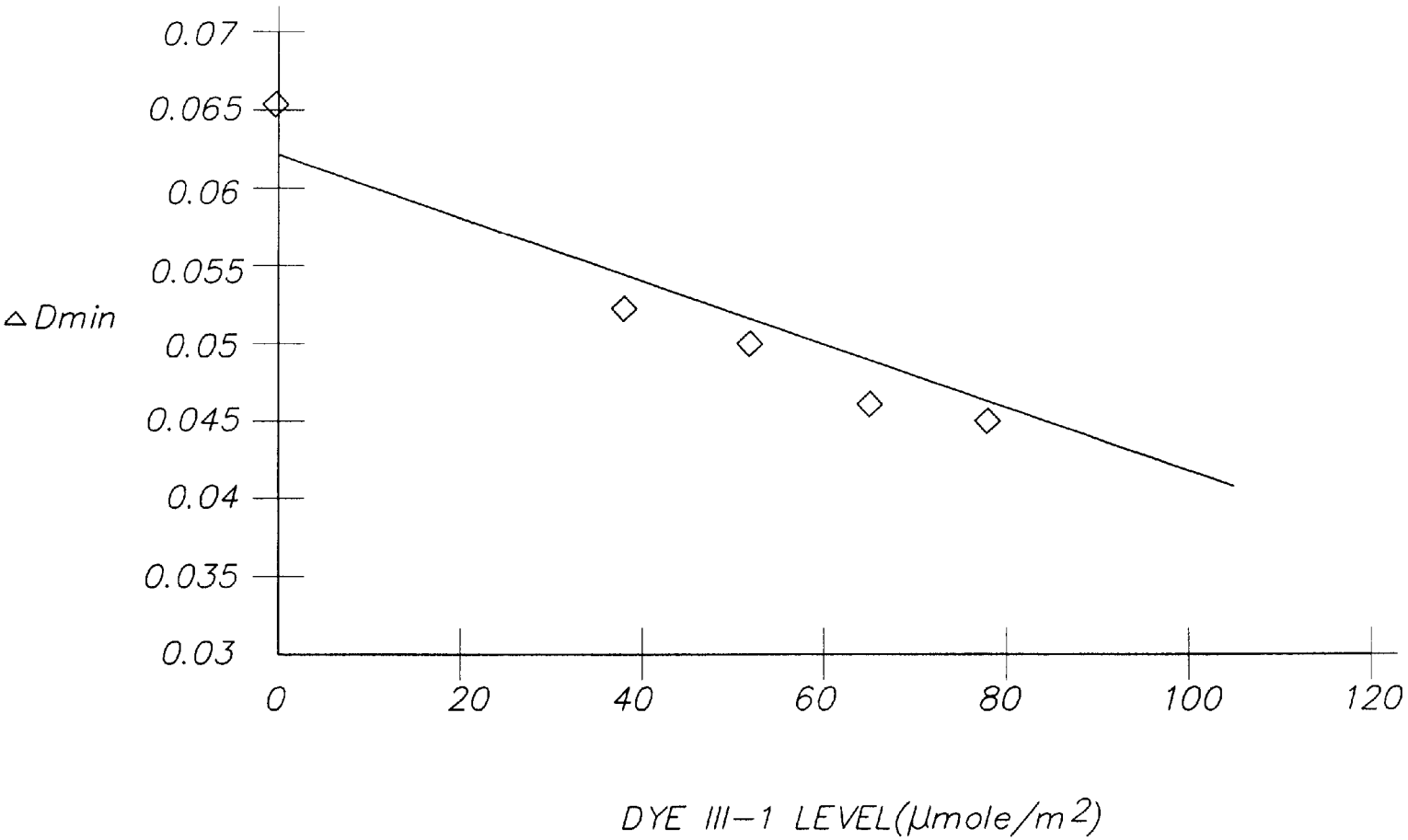
FIG. 2 is a graphical representation of the change (Δ) in $D_{min}$ after heat treatment vs. the concentration of indolenine dye in the photothermographic material, as described in Example 3 below.

The photothermographic materials of the invention and the Control material described in Example 2 were also evaluated for the change in $D_{min}$ after heat treatment. The results are plotted in FIG. 2 as change in $D_{min}$ vs. concentration of indolenine dye III-1 (μmol/$m^2$). The improvement in image stability at $D_{min}$ increases with increased amount of indolenine dye.

Figure 3:
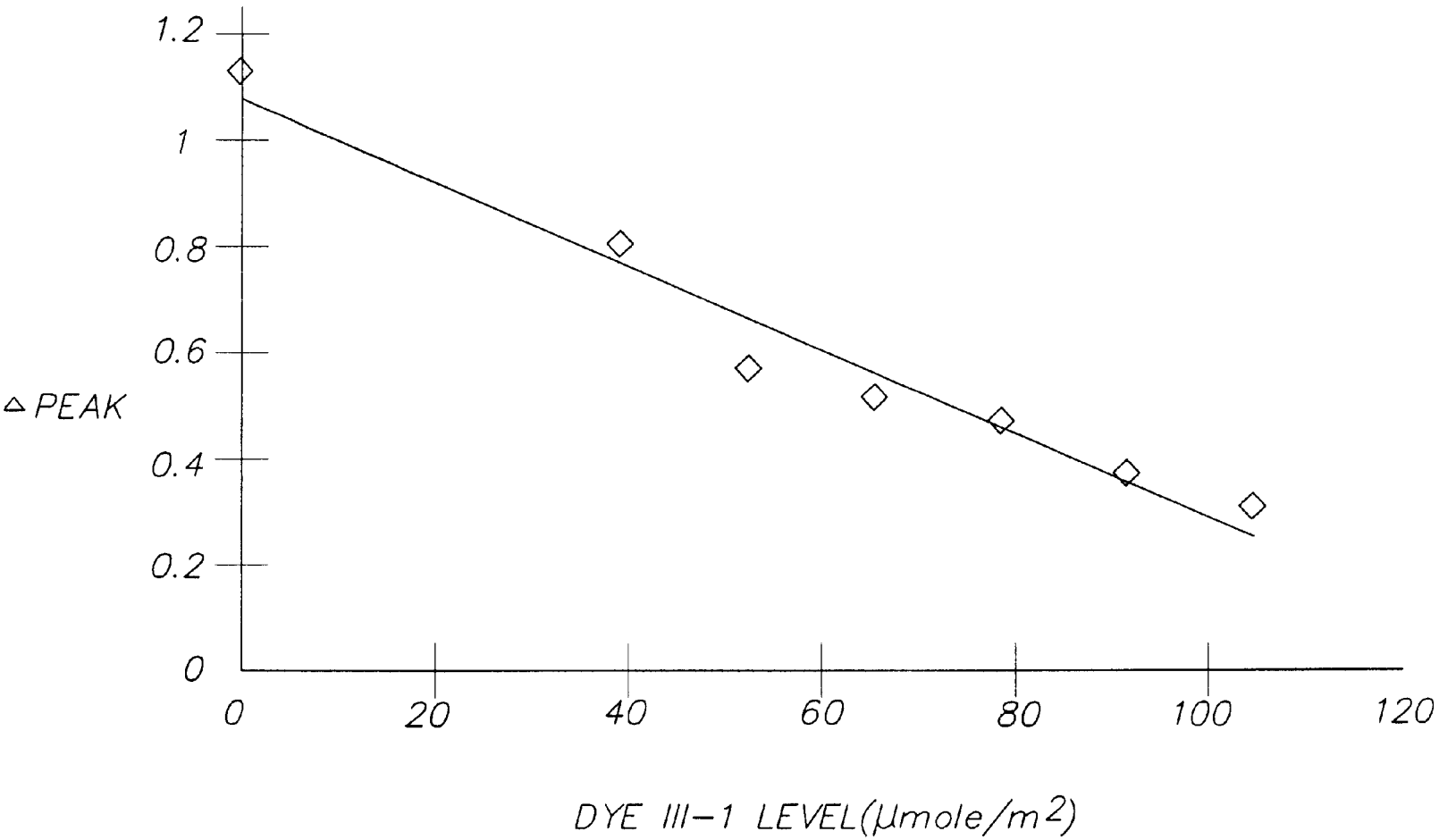
FIG. 3 is a graphical representation of the peak change (Δ) in image density after heat treatment vs. the concentration of indolenine dye in the photothermographic material, as described in Example 3 below.

In addition, these photothermographic materials were evaluated for image stability in the mid-tone density region by evaluating the peak change (peak Δ) in image density with concentration of indolenine dye III-1. The results are plotted in FIG. 3 as peak Δ vs. dye level (μmol/$m^2$). The use of the indolenine dye clearly also improves image stability in the mid-tone density region.

EXAMPLES 4–7

Additional photothermographic materials of the present invention were prepared, containing various indolenine dyes to improve post-processing image stability. They were prepared, imaged, and heat-developed as described in Example 1b, with the appropriate dye amount to give the coverage listed in TABLE IV. A Control C photothermographic material was again similarly prepared except that it did not contain an indolenine dye. All samples of photothermographic materials were illuminated with fluorescent light for 4.5 hours as described in Example 1, and image stability was evaluated after the samples were kept in the oven for 3 hours.

TABLE IV shows various indolenine dyes, their coverage, and the resulting changes in image density. The % Improvement in $\Delta D_{min}$ and % Improvement in Peak Δ values listed in TABLE IV were determined in relation to the image density changes in the Control C material (the more negative the number, the greater the improved heat-stability compared to Control C). It is evident that the materials of the present invention exhibited improved image stability when exposed to high temperatures after imaging and development.

TABLE IV

| Material | Indolenine Dye* | Coverage ($\mu$mol/m$^2$) | $\Delta D_{min}$ | % Improvement in $\Delta D_{min}$ | Peak Δ | % Improvement in Peak Δ |
|---|---|---|---|---|---|---|
| Control C | None | 0 | 0.115 | 0% | 1.52 | 0% |
| Example 4 | III-1 | 79 | 0.076 | −34% | 0.91 | −40% |
| Example 5 | III-6 | 69 | 0.101 | −12% | 1.02 | −33% |
| Example 6 | III-8 | 77 | 0.086 | −26% | 1.30 | −15% |
| Example 7 | III-9 | 64 | 0.081 | −30% | 1.08 | −29% |

*All counterions are perchlorate

EXAMPLES 8–10

Still additional photothermographic materials of the present invention were prepared, imaged, and heat-developed as described in Examples 4–7. Control D was prepared similarly to Control C. In Example 10, the photothermographic material contained a mixture of two indolenine dyes.

The particular indolenine dyes, their coverage, and the results of heat-stability tests are shown below in TABLE V. The % Improvement in $\Delta D_{min}$ and % Improvement in Peak Δ values listed in TABLE V were determined in relation to the image density changes in the Control D material (the more negative the number, the greater the improved heat-stability compared to Control D). It is evident that the materials of the present invention exhibited improved image stability when exposed to high temperatures after imaging and development.

EXAMPLE 11

Still additional photothermographic materials of the present invention were prepared, imaged, and heat-developed as described in Examples 4–7. Control E was prepared similarly to Control C.

The particular indolenine dyes, their coverage, and the results of heat-stability tests are shown below in TABLE VI. The % Improvement in $\Delta D_{min}$ and % Improvement in Peak Δ values listed in TABLE VI were determined in relation to the image density changes in the Control E material (the more negative the number, the greater the improved heat-stability compared to Control E). It is evident that the materials of the present invention exhibited improved image stability when exposed to high temperatures after imaging and development.

TABLE V

| Material | Indolenine Dye* | Coverage ($\mu$mol/m$^2$) | $\Delta D_{min}$ | % Improvement in $\Delta D_{min}$ | Peak Δ | % Improvement in Peak Δ |
|---|---|---|---|---|---|---|
| Control D | None | 0 | 0.165 | 0% | 1.76 | 0% |
| Example 8 | III-5 | 44 | 0.132 | −20% | 1.38 | −21% |
| Example 9 | III-4 | 47 | 0.126 | −23% | 1.36 | −23% |
| Example 10 | III-1 & III-5 | 39, 22 | 0.116 | −30% | 1.22 | −31% |

*All counterions are perchlorate

TABLE VI

| Material | Indolenine Dye* | Coverage ($\mu$mol/m$^2$) | $\Delta D_{min}$ | % Improvement in $\Delta D_{min}$ | Peak Δ | % Improvement in Peak Δ |
|---|---|---|---|---|---|---|
| Control E | None | 0 | 0.171 | 0% | 1.98 | 0% |
| Example 11 | III-3* | 63 | 0.132 | −23% | 1.22 | −38% |

*The counterion is perchlorate

TABLE VII

| Material | Indolenine Dye* | Coverage ($\mu$mol/m$^2$) | $\Delta D_{min}$ | % Improvement in $\Delta D_{min}$ | Peak Δ | % Improvement in Peak Δ |
|---|---|---|---|---|---|---|
| Control F | None | 0 | 0.068 | 0% | 1.35 | 0% |
| Example 12 | III-11 | 50 | 0.060 | −12% | 0.71 | −47% |
| Example 13 | III-12 | 50 | 0.062 | −10% | 0.74 | −45% |

*All counterions are tetrafluoroborate

EXAMPLE 12–13

Still additional photothermographic materials of the present invention were prepared, imaged, and heat-developed as described in Examples 4–7. Control F was prepared similarly to Control C.

The particular indolenine dyes, their coverage, and the results of heat-stability tests are shown above in TABLE VI. The % Improvement in $\Delta D_{min}$ and % Improvement in Peak Δ values listed in TABLE VII were determined in relation to the image density changes in the Control F material (the more negative the number, the greater the improved heat-stability compared to Control F). It is evident that the materials of the present invention exhibited improved image stability when exposed to high temperatures after imaging and development.

The invention has been described in detail with particular reference to certain preferred embodiments thereof, but it will be understood that variations and modifications can be effected within the spirit and scope of the invention.

We claim:

1. A black-and-white photothermographic material comprising a support having on one side thereof:

a) a thermally-developable imaging layer(s) comprising a hydrophobic binder and in reactive association, a photosensitive silver halide, one or more non-photosensitive silver carboxylates, a hindered phenol reducing agent, an indolenine dye that is one of the following compounds III-1 to III-27 wherein $W^-$ is an anion, and a benzothiazole dye that is one of the following compounds II-1 to II-11 wherein $X^-$ is an anion, b) a hydrophobic protective layer that is farther from said support than said imaging layer(s), said photothermographic material also comprising an antihalation layer on the backside of said support, said antihalation layer comprising a binder and an antihalation dye,

III-1

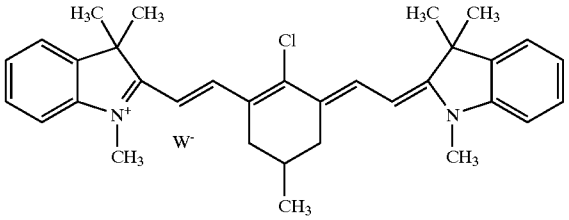

-continued

III-2

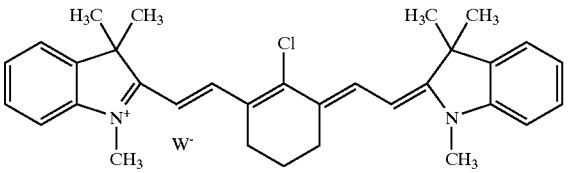

III-3

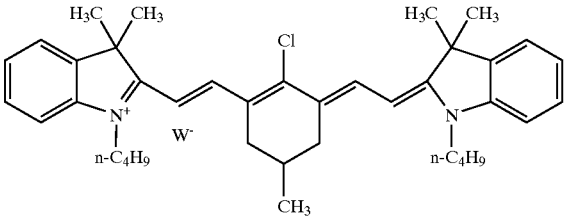

III-4

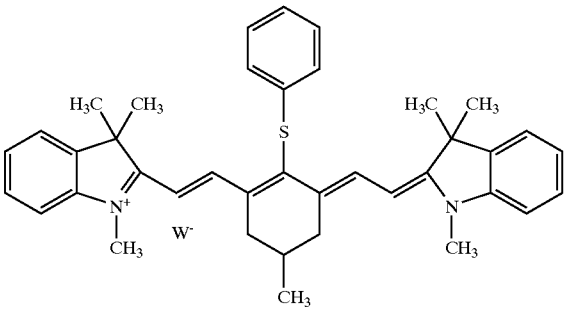

III-5

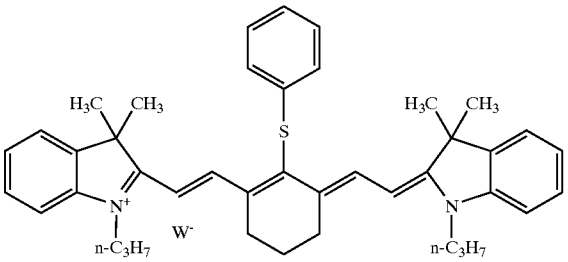

III-6

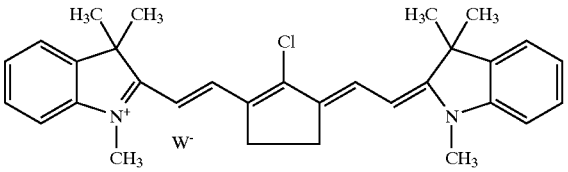

-continued
III-7
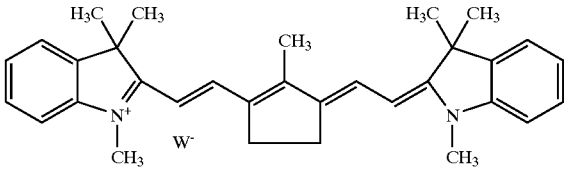
III-8
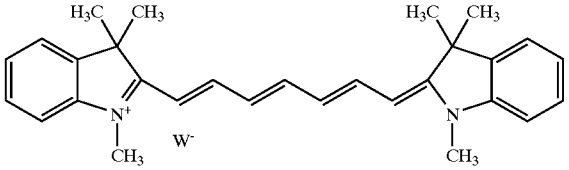
III-9
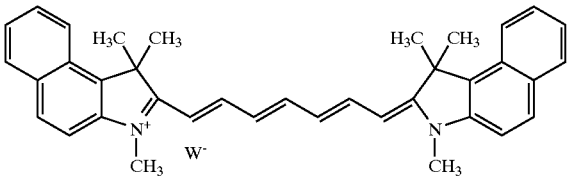
III-10
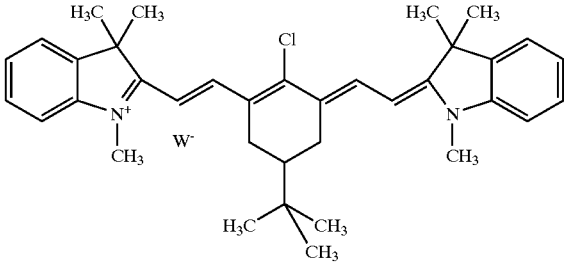
III-11
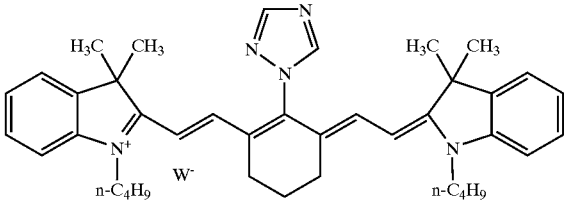
III-12
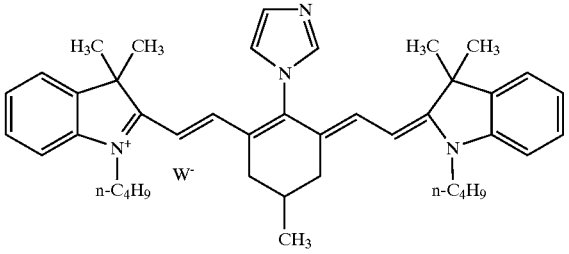
III-13
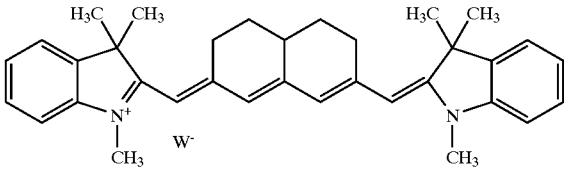
-continued
III-14
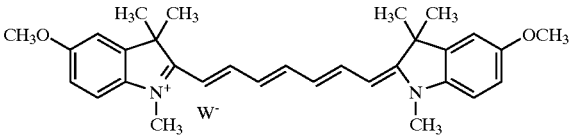
III-15
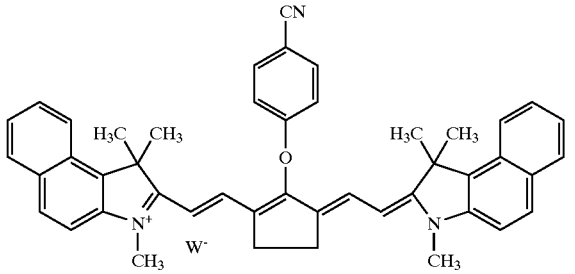
III-16
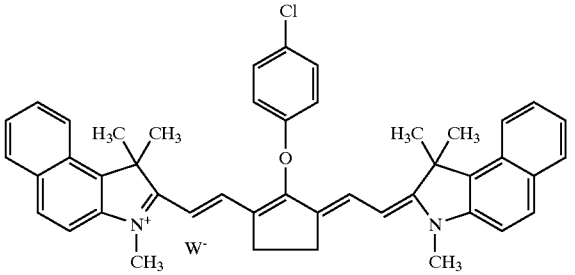
III-17
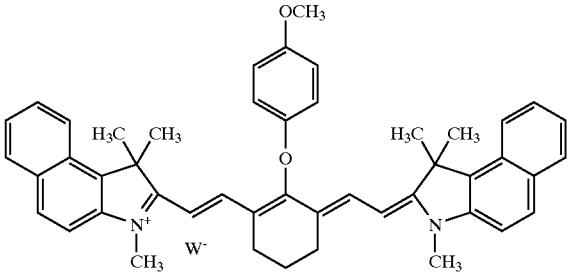
III-18
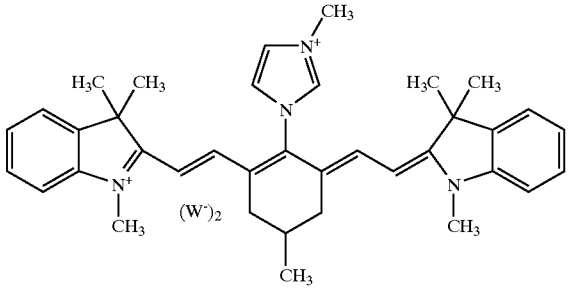
III-19
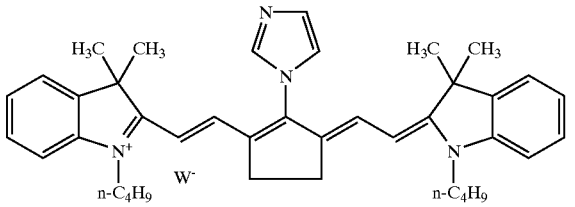

-continued
III-20
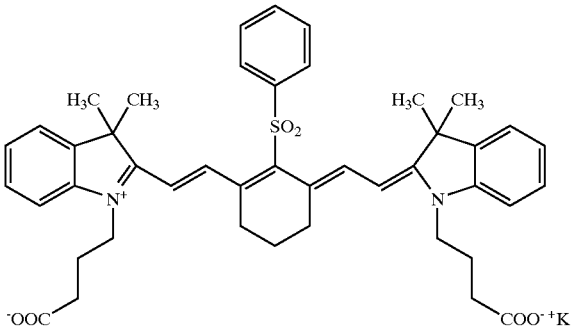
III-21
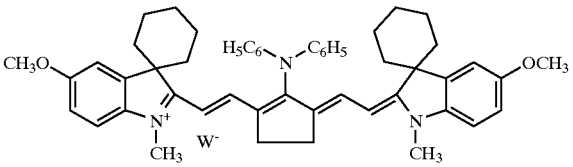
III-22
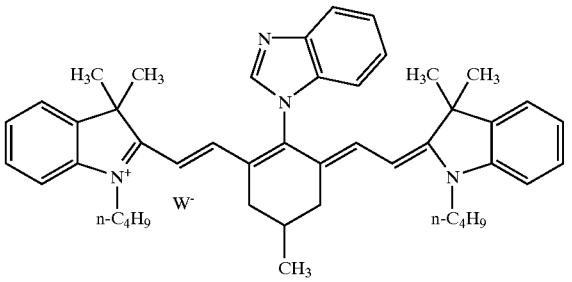
III-23
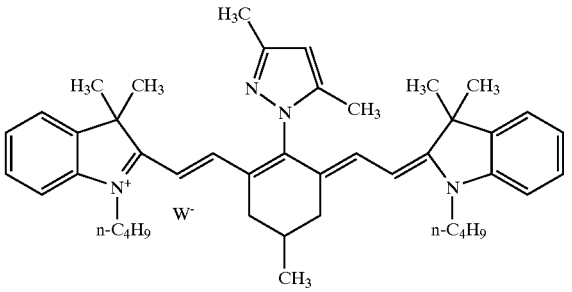
III-24
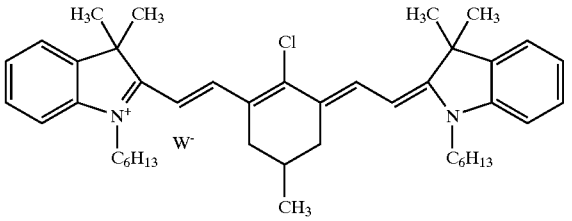
III-25
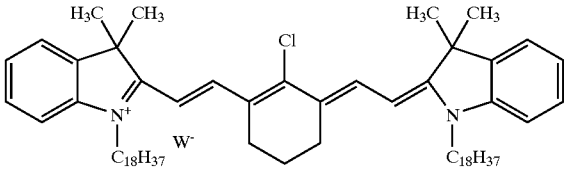
-continued
III-26
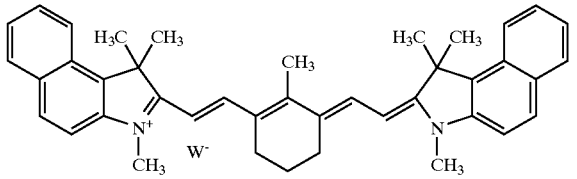
III-27
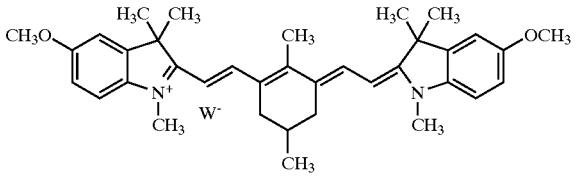
II-1
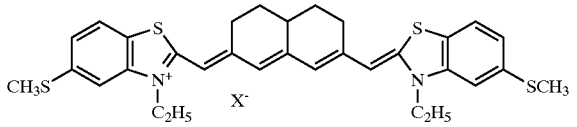
II-2
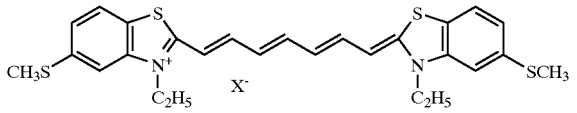
II-3
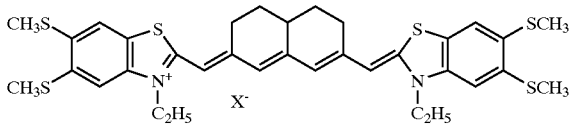
II-4
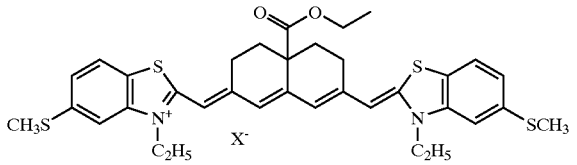
II-5
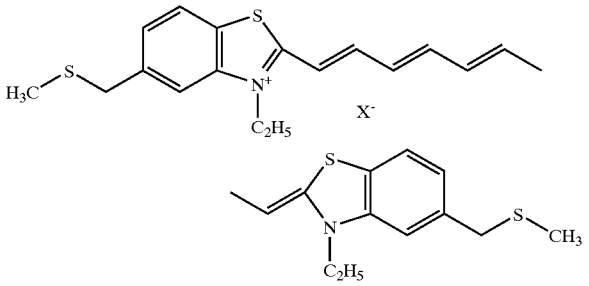
II-6
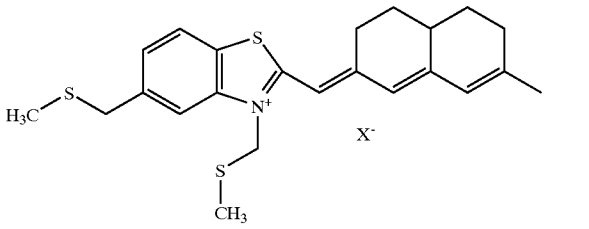

-continued

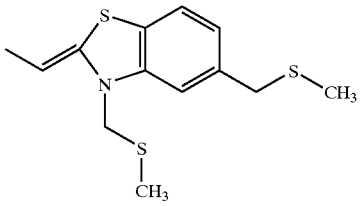

II-7

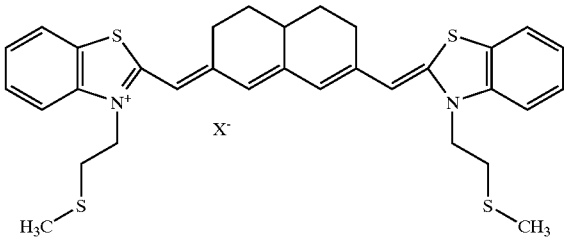

II-8

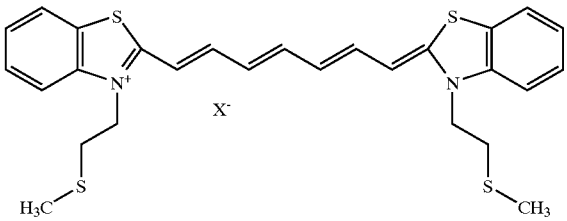

II-9

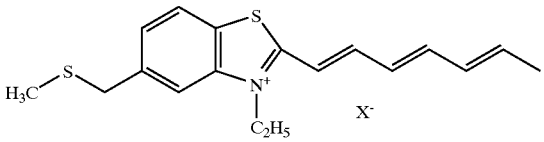

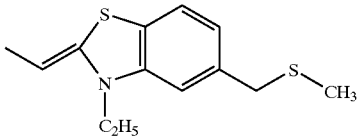

II-10

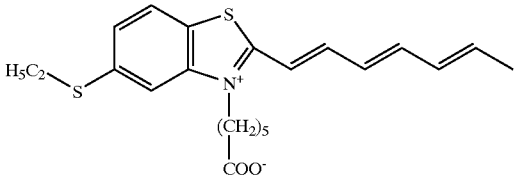

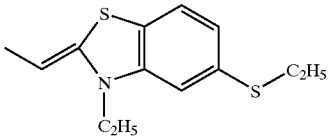

II-11

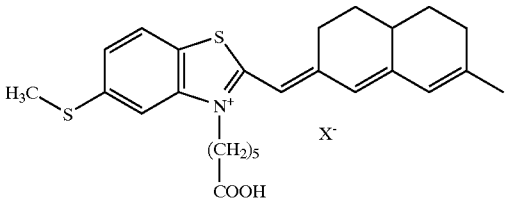

-continued

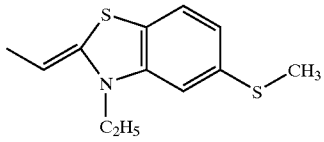

2. The photothermographic material of claim 1 wherein said antihalation layer comprises cyclobutenediylium, 1,3-bis[2,3-dihydro-2,2-bis[[1-oxohexyl)oxy]methyl]-1H-perimidin-6-yl]-2,4-dihydroxy-, bis(inner salt), or 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate as an antihalation dye.

3. The photothermographic material of claim 1 wherein said photosensitive silver halide comprises at least silver bromide or silver bromoiodide, and said non-photosensitive source of reducible silver ions comprises at least silver behenate.

4. The photothermographic material of claim 1 further comprising a high contrast co-developing agent and/or a polyhalo antifoggant in said thermally-developable imaging layer(s).

5. A method of forming a visible image comprising:

A) imagewise exposing the black-and-white photothermographic material of claim 1 to electromagnetic radiation at a wavelength greater than 700 nm to form a latent image, and B) simultaneously or sequentially, heating said exposed photothermographic material to develop said latent image into a visible image.

6. A black-and-white photothermographic material comprising a support having on one side thereof:

a) a thermally-developable, high contrast imaging layer(s) comprising a hydrophobic binder and in reactive association, a photosensitive silver halide, one or more non-photosensitive silver carboxylates, a hindered phenol reducing agent, an indolenine dye that is one of the following compounds III-1 to III-27 wherein $w^-$ is an anion, and a merocyanine dye that is one of the following compounds I-1 to I-13 wherein $X^-$ is an anion b) a hydrophobic protective layer that is farther from said support than said imaging layer(s), said photothermographic material also comprising an antihalation layer on the backside of said support, said antihalation layer comprising a binder and an antihalation dye,

III-1

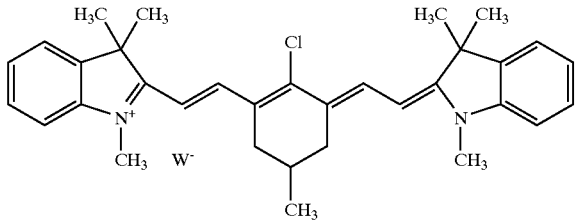

-continued
III-2
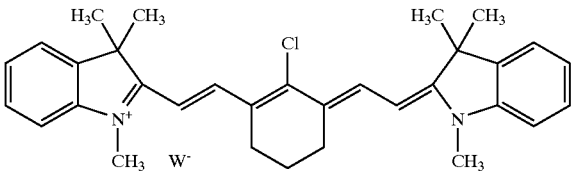
III-3
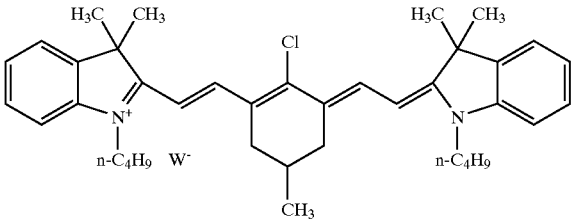
III-4
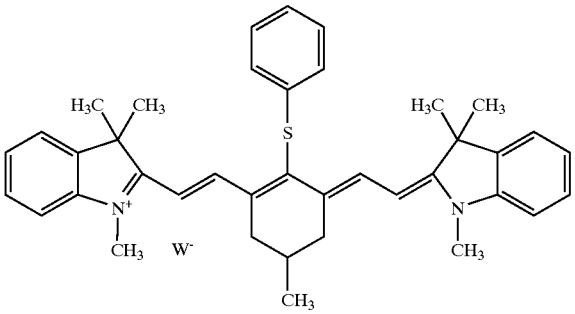
III-5
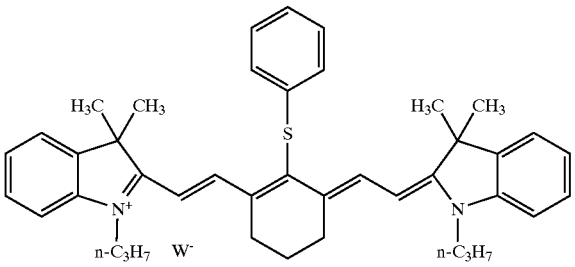
III-6
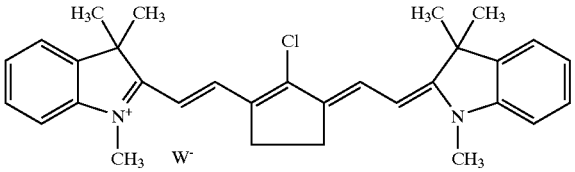
III-7
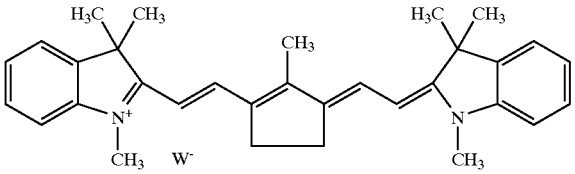
-continued
III-8
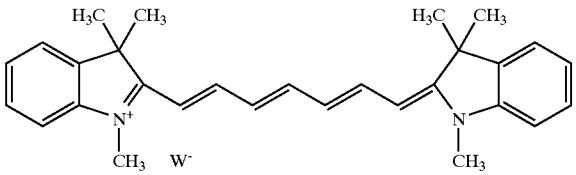
III-9
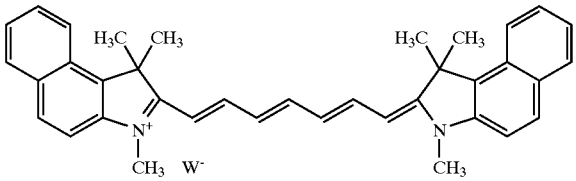
III-10
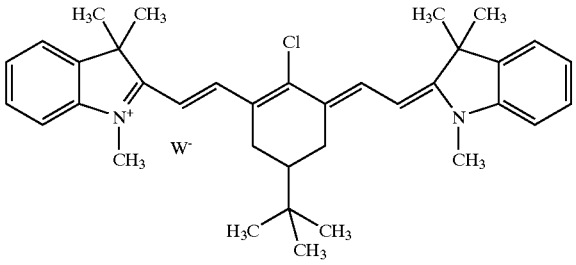
III-11
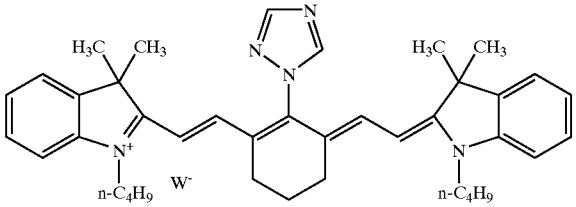
III-12
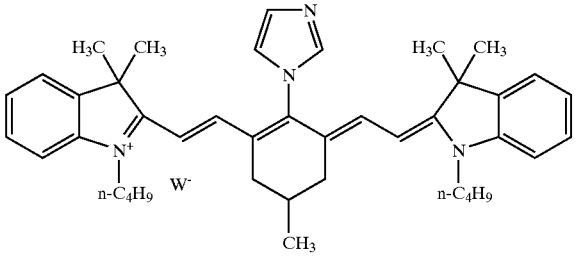
III-13
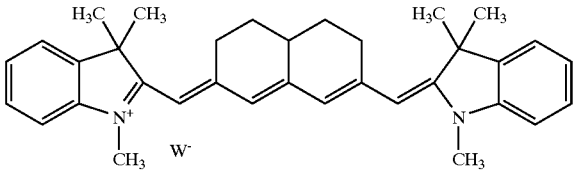
III-14
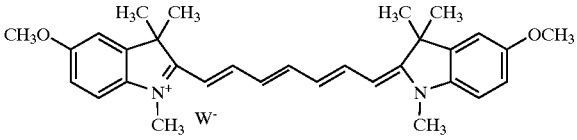

-continued
III-15
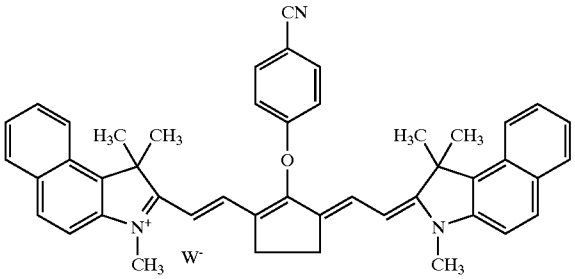
III-16
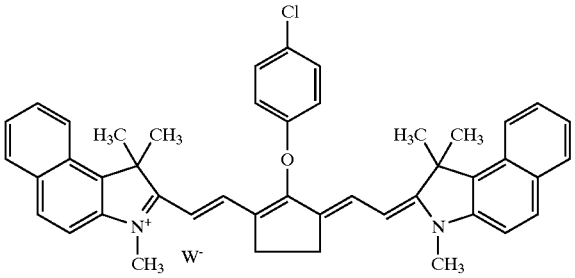
III-17
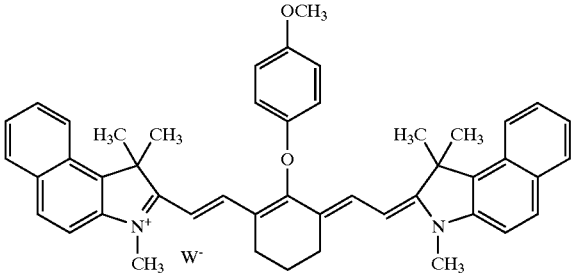
III-18
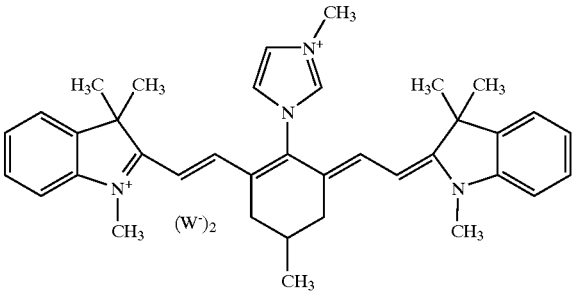
III-19
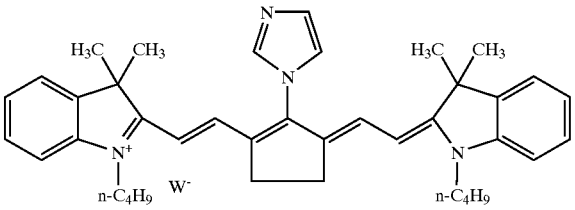
-continued
III-20
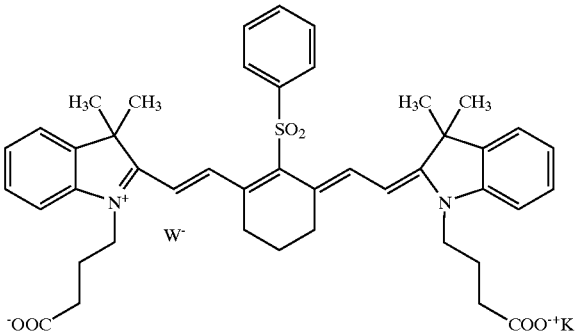
III-21
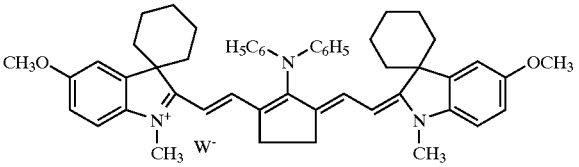
III-22
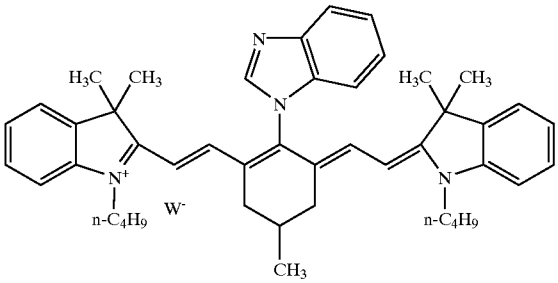
III-23
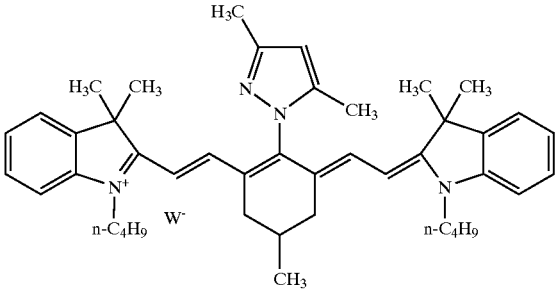
III-24
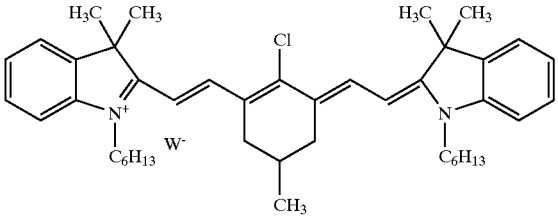
III-25
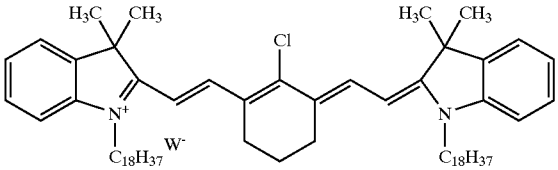

-continued
III-26
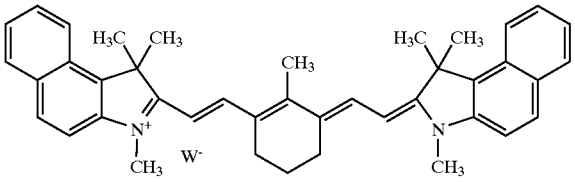
III-27
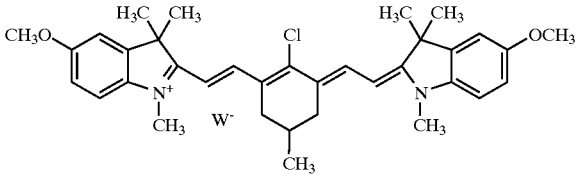
I-1
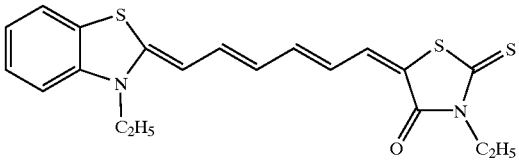
I-2
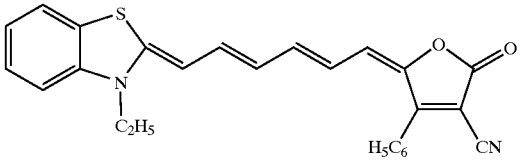
I-3
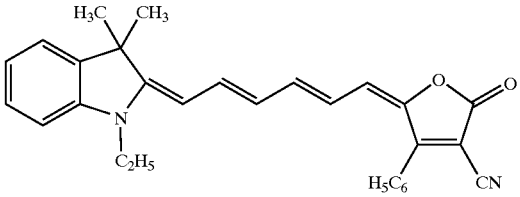
I-4
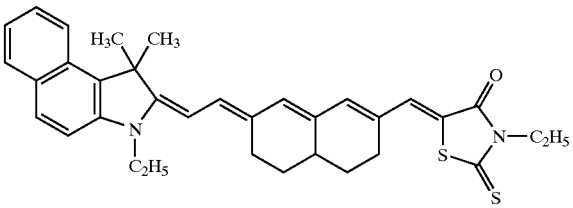
I-5
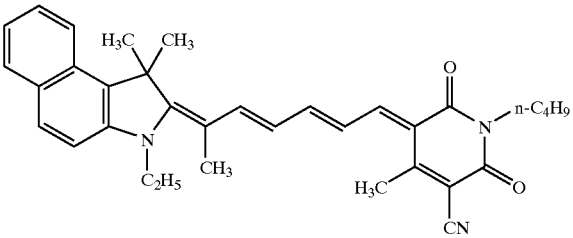
-continued
I-6
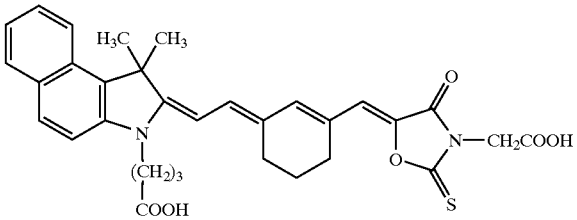
I-7
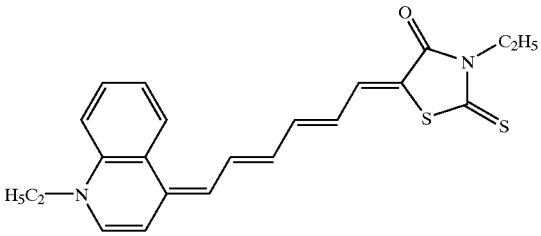
I-8
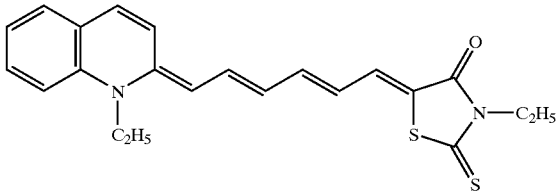
I-9
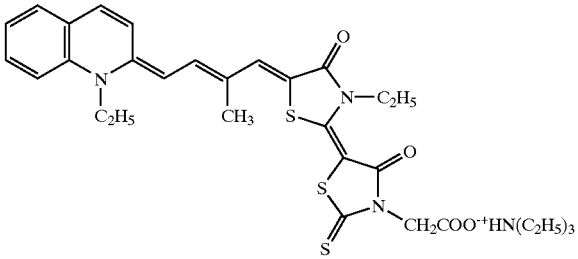
I-10
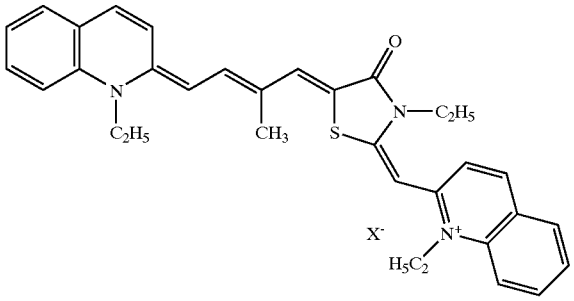
I-11
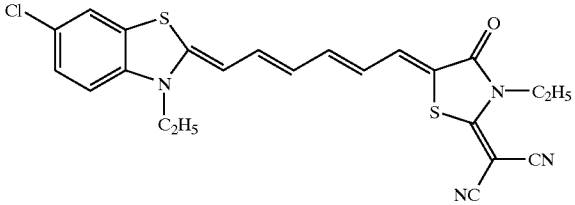

-continued

I-12

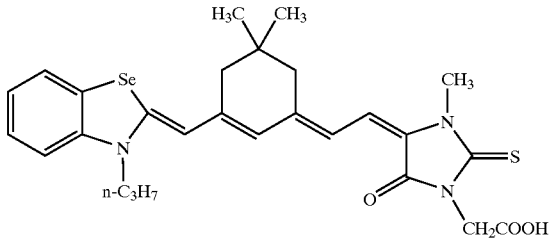

I-13

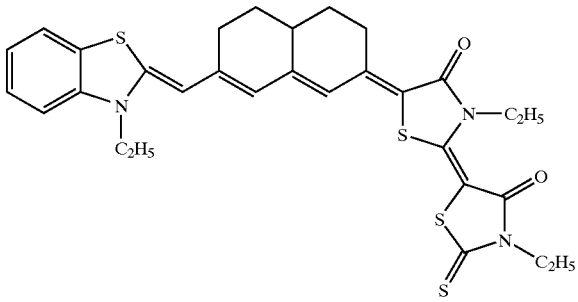

7. The photothermographic material of claim 6 wherein said antihalation layer comprises cyclobutenediylium, 1,3-bis[2,3-dihydro-2,2-bis[[1-oxohexyl)oxy]methyl]-1H-perimidin-6-yl]-2,4-dihydroxy-, bis(inner salt), or 3 H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate as an antihalation dye.

8. The photothermographic material of claim 6 wherein said photosensitive silver halide comprises at least silver bromide or silver bromoiodide, and said non-photosensitive source of reducible silver ions comprises at least silver behenate.

9. A black-and-white photothermographic material that is sensitive at a wavelength greater than 700 nm, and comprises a support having thereon one or more thermally-developable imaging layers comprising a binder and in reactive association, a photosensitive silver halide, a non-photosensitive source of reducible silver ions, a reducing composition for said non-photosensitive source of reducible silver ions, and a spectral sensitizing dye for said photosensitive silver halide that is a merocyanine dye, or a cyanine dye that comprises one or more thioalkyl, thioaryl, or thioether groups, wherein said one or more thermally-developable layers further comprises one or more indolenine dyes as post-processing stabilizing compounds and a substituted propenenitrile compound.

10. The photothermographic material of claim 9 further comprising a surface protective layer on the same side of said support as said one or more thermally-developable layers, an antihalation layer on the opposite side of said support, or both a surface protective layer and an antihalation layer on their respective sides of said support.

11. The photothermographic material of claim 9 wherein said non-photosensitive source of reducible silver ions is a silver fatty acid carboxylate having 10 to 30 carbon atoms in the fatty acid or a mixture of said silver carboxylates.

12. The photothermographic material of claim 9 wherein said reducing composition comprises at least one hindered phenol.

13. The photothermographic material of claim 12 further comprising a high contrast co-developing agent.

14. The photothermographic material of claim 12 wherein said binder is a hydrophobic binder.

15. The photothermographic material of claim 9 that has a total spectral absorbance of 0.5 or more at a wavelength in the range of from about 750 to about 850 nm.

16. The photothermographic material of claim 9 wherein said one or more indolenine dyes are present in an amount of at least $10^{-6}$ mole per square meter, and said one or more merocyanine or cyanine spectral sensitizing dyes are present in an amount of at least $10^{-10}$ mole per mole of total silver.

17. The photothermographic material of claim 16 wherein said one or more indolenine dyes are present in an amount of at least $10^{-5}$ mole per square meter, and said one or more merocyanine or cyanine spectral sensitizing dyes are present in an amount of from about $10^{-7}$ to about $10^{-2}$ mole per mole of total silver.

18. The photothermographic material of claim 9 wherein said one or more merocyanine spectral sensitizing dyes are represented by the following Structure I:

I

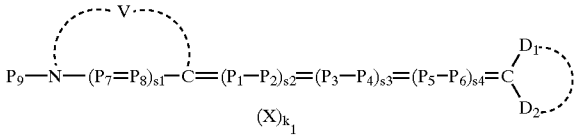

wherein V is a group of atoms necessary to form a 5- or 6-membered nitrogen-containing heterocycle, $D_1$ and $D_2$ represent the atoms necessary to form an acyclic or cyclic nucleus, $P_9$ is an alkyl, aryl, or alkaryl group, $P_1$, $P_2$, $P_3$, $P_4$, $P_5$, $P_6$, $P_7$, and $P_8$ each is a methine group, which may form a ring with another methine group or a ring with an auxochrome, s1, s2, and s3 are each equal to 0 or 1, s4 is equal to 0, 1, or 2, X is an electric charge neutralizing counterion, and $k_1$ is an integer inclusive of 0 necessary to neutralize an electric charge in the molecule, and said cyanine spectral sensitizing dyes are represented by the following Structure II:

II

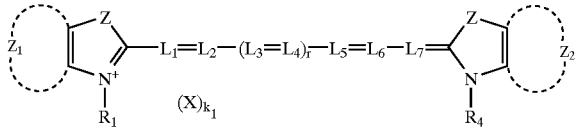

wherein Z is a thio, oxo, or seleno group, r is 0, 1, or 2, and $R_1$ and $R_4$ are independently alkyl or aryl groups, $Z_1$ and $Z_2$ independently represent 4 or 8 carbon atoms necessary to provide a benzo- or naphtho-condensed ring, $L_1$, $L_2$, $L_3$, $L_4$, $L_5$, $L_6$, and $L_7$ independently represent substituted or unsubstituted methine groups, provided at least one of $Z_1$, $Z_2$, $R_1$, $R_4$, $L_1$, $L_2$, $L_3$, $L_4$, $L_5$, $L_6$, and $L_7$ is substituted with at least one thioalkyl, thioaryl, or thioether group, and X is a charge-neutralizing counterion, and $k_1$ is an integer inclusive of 0 and represents sufficient counterions to provide a net charge of zero.

19. The photothermographic material of claim 9 wherein said one or more indolenine dyes are represented by the following Structure III:

III

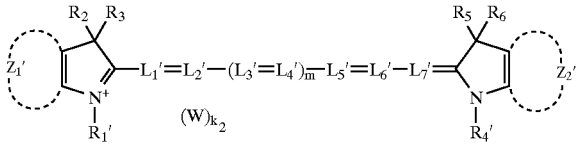

wherein $R_1'$, $R_2$, $R_3$, $R_4'$, $R_5$, and $R_6$ are independently alkyl or aryl groups, $Z_1'$ and $Z_2'$ independently represent 4 or 8 carbon atoms necessary to provide a benzo- or naphtho-condensed ring, $L_1'$, $L_2'$, $L_3'$, $L_4'$, $L_5'$, $L_6'$, and $L_7'$ independently represent substituted or unsubstituted methine groups, m is 0, 1 or 2, W is a charge neutralizing counterion, and $k_2$ is an integer inclusive of 0 and represents sufficient counterions to provide a net charge of zero.

20. The photothermographic material of claim 19 wherein said one or more indolenine dyes are represented by the following Structure III-a:

III-a

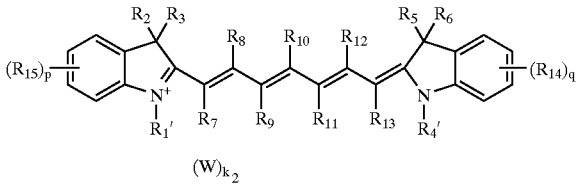

wherein $R_1'$, $R_2$, $R_3$, $R_4'$, $R_5$ and $R_6$ are independently alkyl or aryl groups, $R_7$, $R_8$, $R_9$, $R_{10}$, $R_{11}$, $R_{12}$, $R_{13}$, $R_{14}$, and $R_{15}$, are independently alkyl, aryl, alkoxy, aryloxy, alkyl(or aryl)—$SO_W$—, halo, secondary or tertiary amino, heterocycyl, alkyl(or aryl)—CO—, alkyl(or aryl)—COO, R"R'"NCO—, nitro, cyano, or R"R'"$NSO_2$— group, R" and R'" are independently alkyl or aryl groups or can be joined together to form a 5- or 6-membered heterocyclic ring, w is 0, 1 or 2, any of $R_1'$ and $R_7$, $R_7$ and $R_8$, $R_8$ and $R_9$, $R_9$ and $R_{10}$, $R_{10}$ and $R_{11}$, $R_{11}$ and $R_{12}$, $R_{12}$ and $R_{13}$, $R_{13}$ and $R_4'$, $R_7$ and $R_9$, $R_8$ and $R_{10}$, $R_9$ and $R_{11}$, $R_{10}$ and $R_{12}$, $R_{11}$ and $R_{13}$ can be joined together to form a 5- or 6-membered ring, or any of the combinations of $R_7$, $R_9$, and $R_{11}$, $R_8$, $R_{10}$, and $R_{12}$, and $R_9$, $R_{11}$, and $R_{13}$, can be combined to form a 5- to 6-membered ring, W is a counterion and $k_2$ is an integer inclusive of 0 and represents sufficient counterions to provide a net charge of zero.

21. The photothermographic material of claim 9 wherein said one or more merocyanine or cyanine dyes are benzothiazole dyes that are represented by the following Structure II-a:

II-a

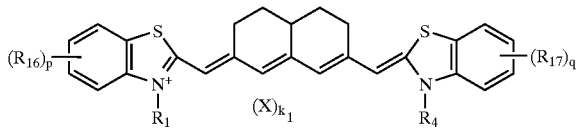

wherein $R_1$ and $R_4$ are independently alkyl or aryl groups, $R_{16}$ and $R_{17}$ independently are substituents that comprise a thioalkyl, thioaryl, or thioether group, p and q are independently 0, 1, or 2, provided that both are not 0, X is a counterion, and $k_1$ is an integer, inclusive of 0 and represents sufficient counterions to provide a net charge of zero.

22. The photothermographic material of claim 9 comprising a single indolenine dye that is one of the following compounds III-1 to III-27 wherein $(W)k_2$ is an anion represented by $W^-$:

III-1

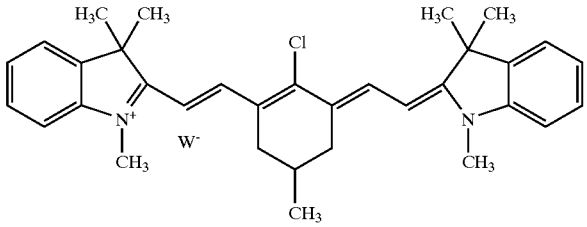

III-2

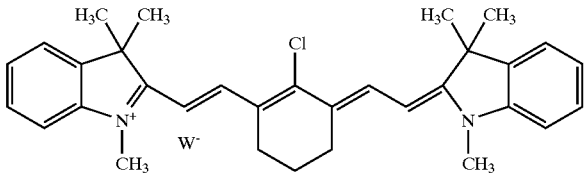

III-3

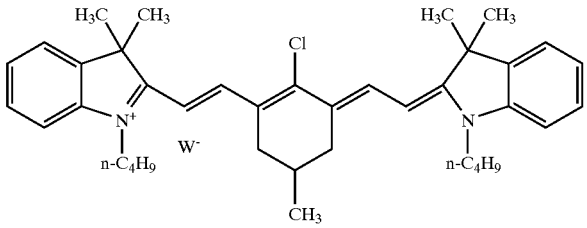

-continued
III-4
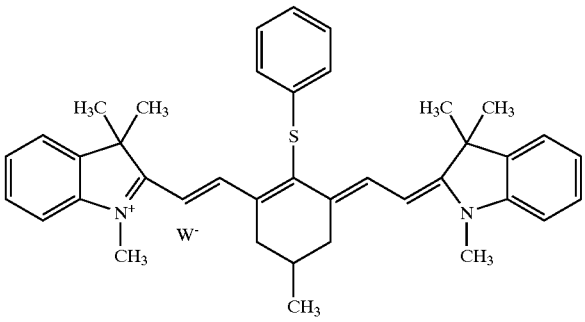
III-5
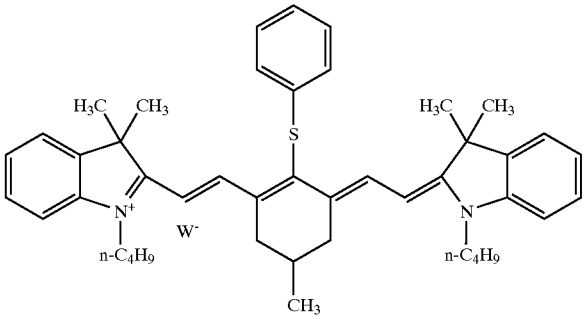
III-6
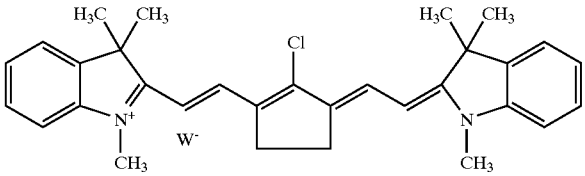
III-7
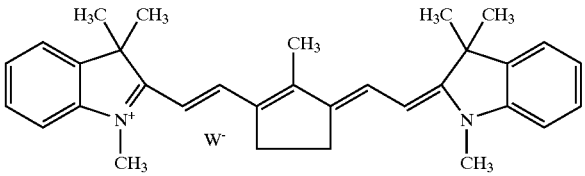
III-8
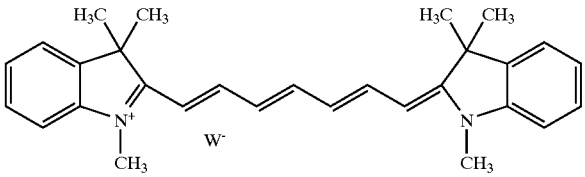
III-9
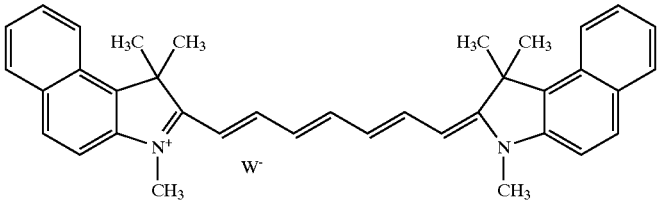

-continued
III-10
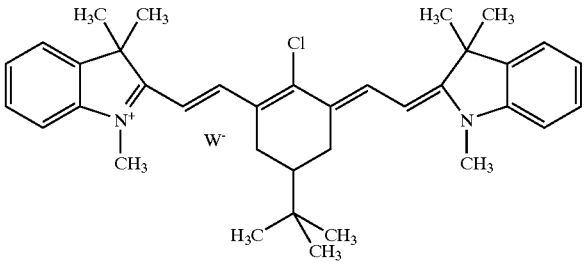
III-11
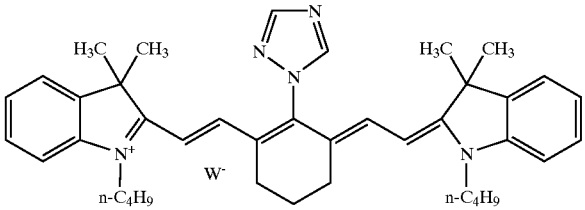
III-12
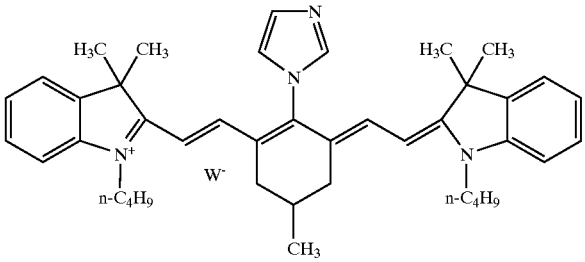
III-13
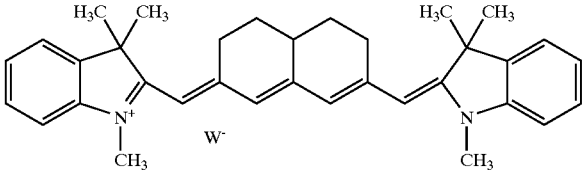
III-14
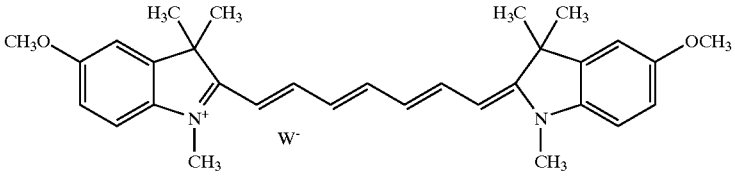
III-15
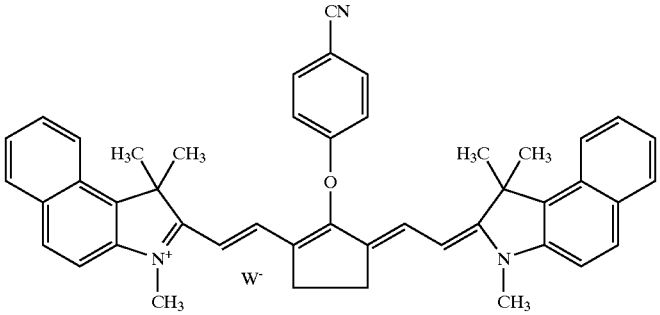

-continued
III-16
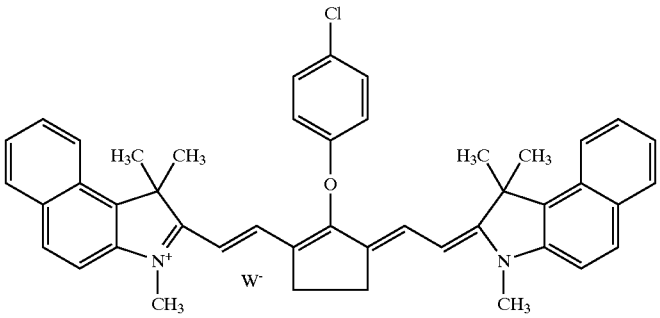
III-17
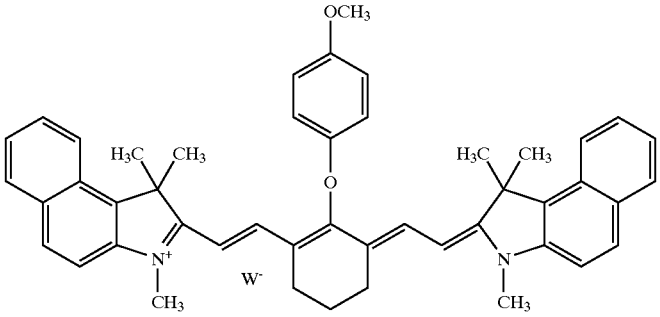
III-18
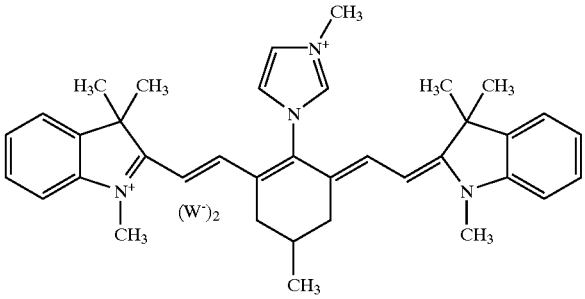
III-19
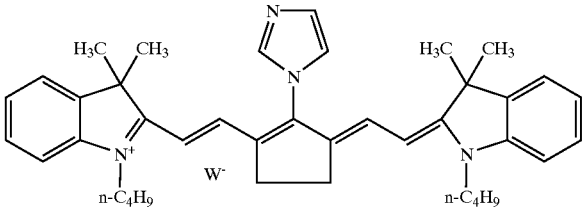
III-20
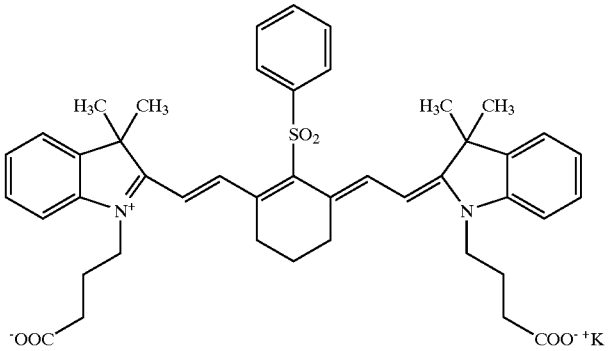

-continued
III-21
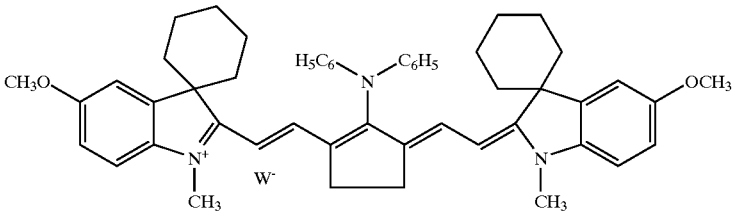
III-22
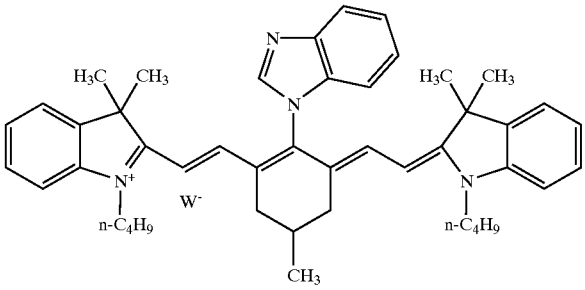
III-23
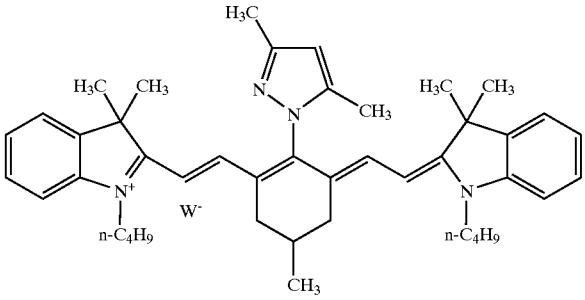
III-24
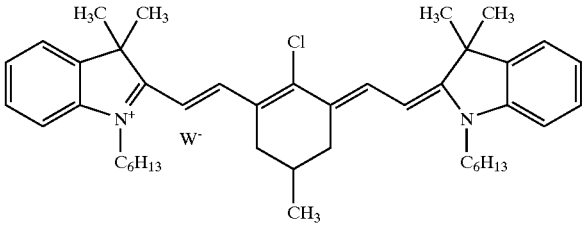
III-25
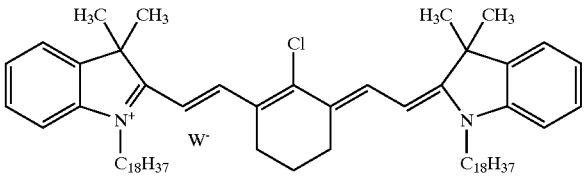
III-26
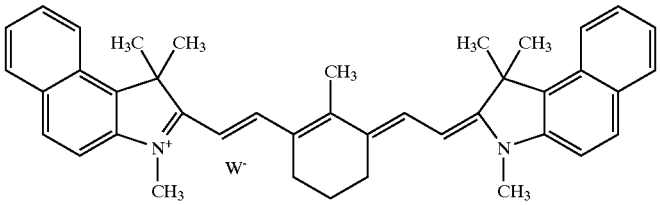

-continued
III-27
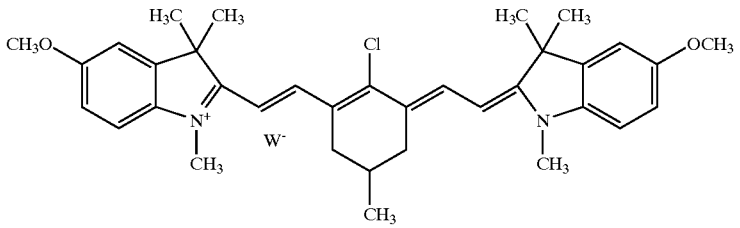
23. The photothermographic material of claim 9 comprising a single merocyanine or cyanine spectral sensitizing dye that is one of the following compounds wherein $(X)k_1$ is an anion represented by $X^-$:
I-1
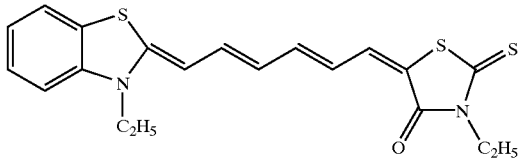
I-2
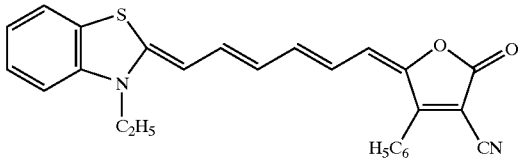
I-3
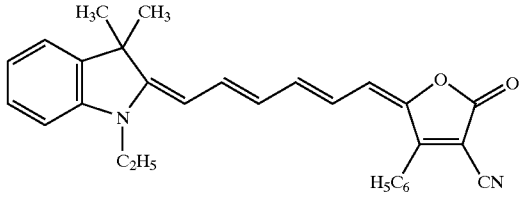
I-4
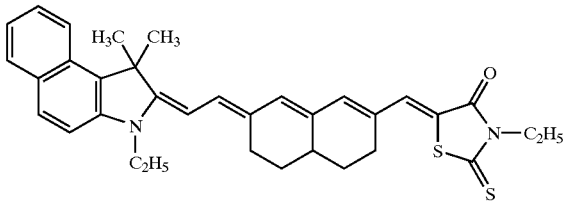
I-5
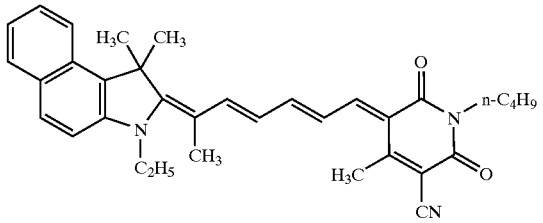
I-6
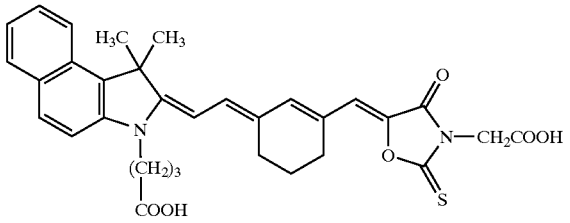
I-7
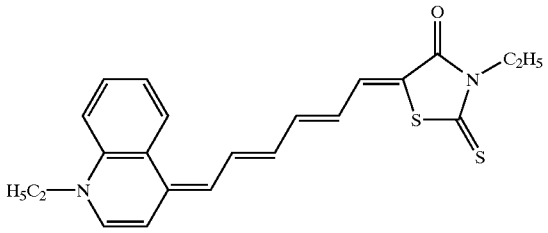
I-8
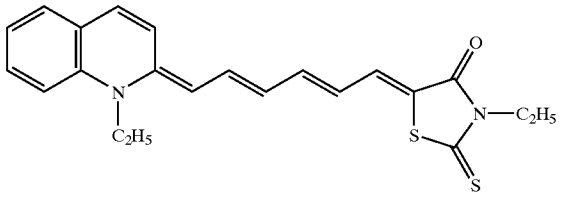
I-9
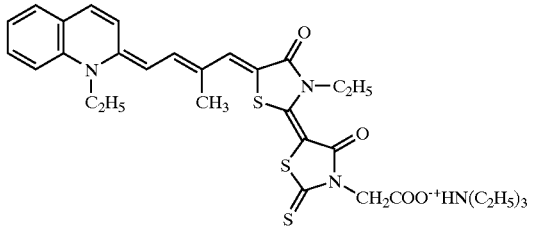
I-10
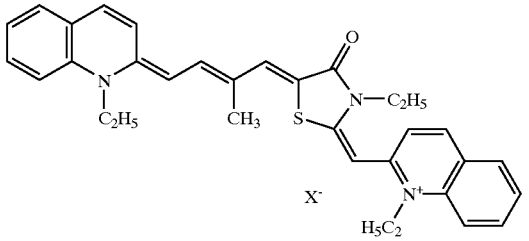

-continued
I-11
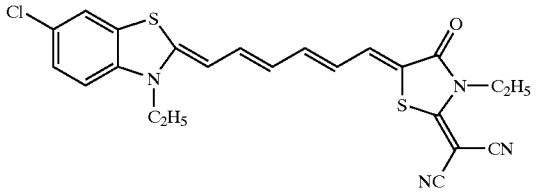
I-12
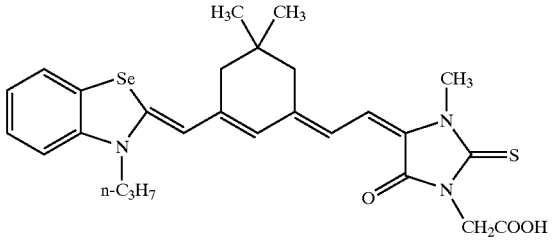
I-13
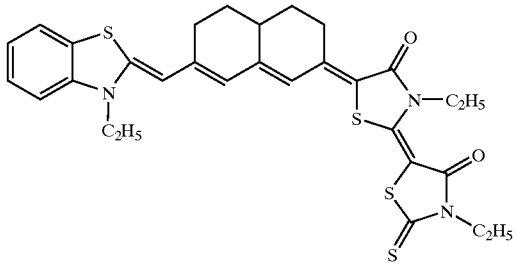
II-1
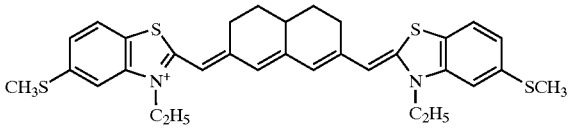
$X^-$
II-2
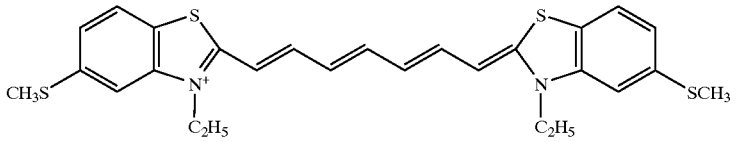
$X^-$
II-3
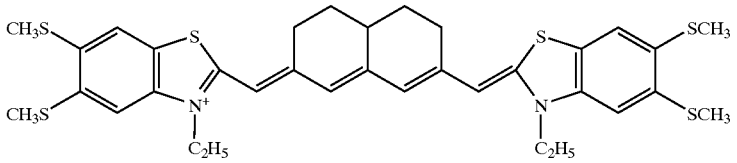
$X^-$
II-4
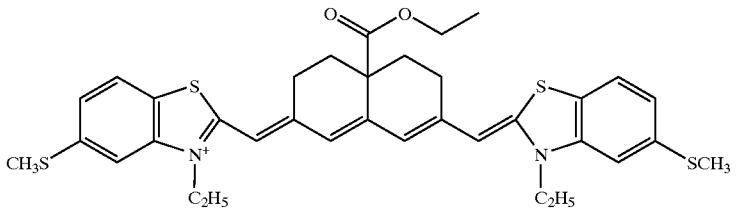
$X^-$
II-5
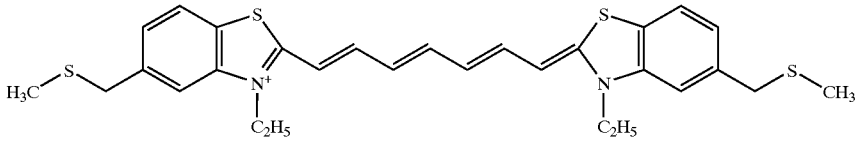
$X^-$ -continued

II-6

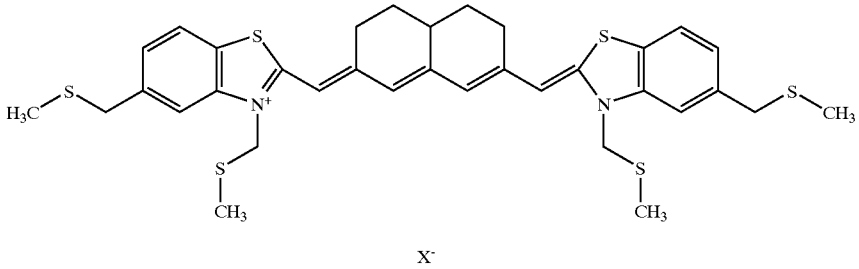

II-7

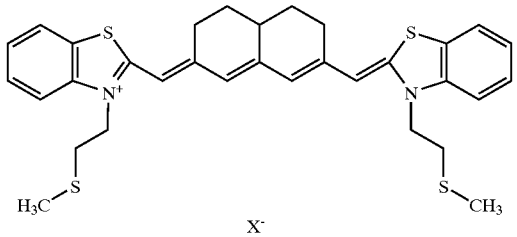

II-8

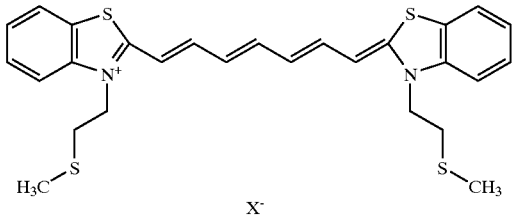

II-9

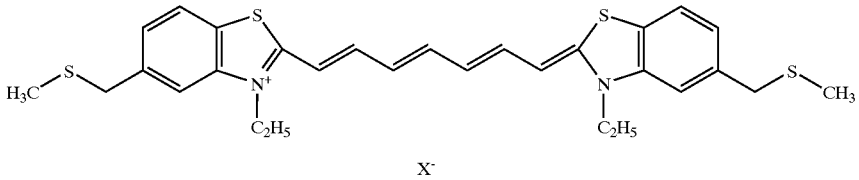

II-10

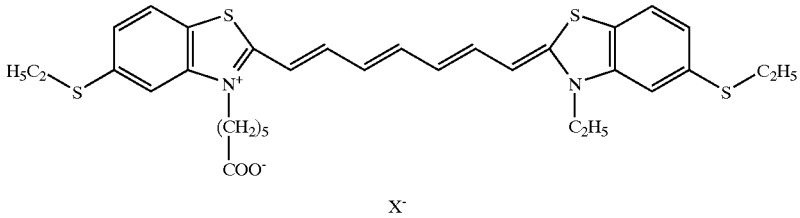

II-11

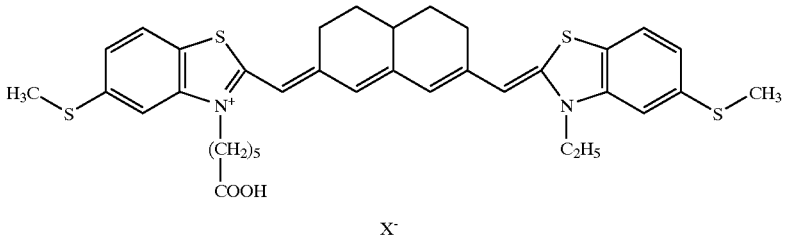

24. The photothermographic material of claim 9 further comprising a polyhalo antifoggant having a $—SO_2C(X')_3$ group wherein X' represents the same or different halogen atoms.

25. A method of forming a visible image comprising:

A) imagewise exposing the black-and-white photothermographic material of claim 9 to electromagnetic radiation at a wavelength greater than 700 nm to form a latent image, and B) simultaneously or sequentially, heating said exposed photothermographic material to develop said latent image into a visible image.

26. The method of claim 25 wherein said photothermographic support is transparent and said method further comprises:

C) positioning said exposed and heat-developed photothermographic material between a source of imaging radiation and an imageable material that is sensitive to said imaging radiation, and D) exposing said imageable material to said imaging radiation through the visible image in said exposed and heat-developed photothermographic material to provide an image in said imageable material.

27. The method of claim 25 wherein said imagewise exposing is carried out using a laser at a wavelength of from about 750 to about 850 nm.

28. A black-and-white photothermographic material that is sensitive at a wavelength greater than 700 nm, and comprises a support having thereon one or more thermally-developable imaging layers comprising a binder and in reactive association, a photosensitive silver halide, a non-photosensitive source of reducible silver ions, a reducing composition for said non-photosensitive source of reducible silver ions, and a spectral sensitizing dye for said photosensitive silver halide that is a merocyanine dye, or a cyanine dye that comprises one or more thioalkyl, thioaryl, or thioether groups, wherein said one or more thermally-developable layers further comprises one or more indolenine dyes as post-processing stabilizing compounds that are represented by the following Structure III:

III

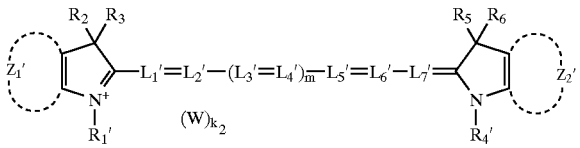

wherein $R_1'$, $R_2$, $R_3$, $R_4'$, $R_5$, and $R_6$ are independently alkyl or aryl groups, $Z_1'$ and $Z_2'$ independently represent 4 or 8 carbon atoms necessary to provide a benzo- or naphtho-condensed ring, $L_1'$, $L_2'$, $L_3'$, $L_4'$, $L_5'$, $L_6'$, and $L_7'$ independently represent substituted or unsubstituted methine groups, m is 0, 1 or 2, W is a charge neutralizing counterion, and $k_2$ is an integer inclusive of 0 and represents sufficient counterions to provide a net charge of zero, provided that when W is an anion, it is an alkylsulfonate, aryldisulfonate, alkylsulfonyl methide or amide, sulfate, thiocyanate, picrate, acetate, hexafluoroantimonate, or trifluoromethanesulfonate ion.

29. A black-and-white photothermographic material that is sensitive at a wavelength greater than 700 nm, and comprises a support having thereon one or more thermally-developable imaging layers comprising a binder and in reactive association, a photosensitive silver halide, a non-photosensitive source of reducible silver ions, a reducing composition for said non-photosensitive source of reducible silver ions, and a spectral sensitizing dye for said photosensitive silver halide that is a merocyanine dye, or a cyanine dye that comprises one or more thioalkyl, thioaryl, or thioether groups, wherein said one or more thermally-developable layers further comprises one or more indolenine dyes as post-processing stabilizing compounds and one or more toners that have been incorporated within said one or more thermally-developable imaging layers prior to coating, said toner being a phthalazine, phthalazine derivative, phthalazinone, or phthalazinone derivative, or a metal salt of a phthalazinone derivative.

30. A black-and-white photothermographic material that is sensitive at a wavelength greater than 700 nm, and comprises a support having thereon one or more thermally-developable imaging layers comprising a binder and in reactive association, a photosensitive silver halide, a non-photosensitive source of reducible silver ions, a reducing composition for said non-photosensitive source of reducible silver ions, and a spectral sensitizing dye for said photosensitive silver halide that is a merocyanine dye, or a cyanine dye that comprises one or more thioalkyl, thioaryl, or thioether groups, wherein said one or more thermally-developable layers further comprises one or more indolenine dyes as post-processing stabilizing compounds, said photosensitive silver halide having been chemically sensitized with a tetrasubstituted thiourea compound or with the combination of a gold(III)-containing compound and a sulfur-containing compound and/or a tellurium-containing compound.

31. A black-and-white photothermographic material that is sensitive at a wavelength greater than 700 nm, and comprises a support having thereon one or more thermally-developable imaging layers comprising a binder and in reactive association, a photosensitive silver halide, a non-photosensitive source of reducible silver ions, a reducing composition for said non-photosensitive source of reducible silver ions, and a spectral sensitizing dye for said photosensitive silver halide that is a merocyanine dye, or a cyanine dye that comprises one or more thioalkyl, thioaryl, or thioether groups, wherein said one or more thermally-developable layers further comprises one or more indolenine dyes as post-processing stabilizing compounds, said photothermographic material further comprising an antihalation layer on the backside of said support that comprises a heat-bleachable antihalation composition.

32. A black-and-white photothermographic material that is sensitive at a wavelength greater than 700 nm, and comprises a support having thereon one or more thermally-developable imaging layers comprising a binder and in reactive association, a photosensitive silver halide, a non-photosensitive source of reducible silver ions, a reducing composition for said non-photosensitive source of reducible silver ions, and a spectral sensitizing dye for said photosensitive silver halide that is a merocyanine dye, or a cyanine dye that comprises one or more thioalkyl, thioaryl, or thioether groups, wherein said one or more thermally-developable layers further comprises one or more indolenine dyes as post-processing stabilizing compounds, said photothermographic material further comprising a high contrast co-developing compound that is a hydroxylamine, alkanolamine, ammonium phthalamate compound, hydroxamic acid compound, or hydrogen donor compound.

* * * * *